US010727594B2

(12) United States Patent
Ndip

(10) Patent No.: US 10,727,594 B2
(45) Date of Patent: Jul. 28, 2020

(54) NDIP ANTENNA

(71) Applicant: Fraunhofer-Gesellschaft zur Foerderung der angewandten Forschung e.V., Munich (DE)

(72) Inventor: Ivan Ndip, Berlin (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 189 days.

(21) Appl. No.: 15/862,207

(22) Filed: Jan. 4, 2018

(65) Prior Publication Data

US 2018/0191071 A1 Jul. 5, 2018

(30) Foreign Application Priority Data

Jan. 5, 2017 (DE) ..... 10 2017 200 129

(51) Int. Cl.
*H01Q 21/00* (2006.01)
*H01Q 9/04* (2006.01)
(Continued)

(52) U.S. Cl.
CPC ..... *H01Q 9/0407* (2013.01); *H01Q 5/342* (2015.01); *H01Q 9/30* (2013.01); *H01Q 21/065* (2013.01);
(Continued)

(58) Field of Classification Search
CPC ..... H01Q 9/0407; H01Q 5/342; H01Q 9/30; H01Q 21/065; H01Q 21/29; H01Q 21/293; H01Q 25/002; H01Q 25/04
See application file for complete search history.

(56) References Cited

U.S. PATENT DOCUMENTS 4,644,361 A * 2/1987 Yokoyanna ..... H01Q 1/3291 343/700 MS
4,755,820 A * 7/1988 Backhouse ..... H01Q 9/0407 343/700 MS
(Continued)

FOREIGN PATENT DOCUMENTS

DE 60008104 T2 8/2004
DE 102006023123 A1 1/2007
(Continued)

OTHER PUBLICATIONS

Enayati, et al., "3D-Antenna-in-Package Solution for Microwave Wireless Sensor Network Nodes", IEEE Transactions on Antennas and Propagation, vol. 59, No. 10, a three-dimensional packaging solution is introduced for wireless sensor network nodes at microwave frequencies. The package has a cubic geometry with radiating antennas on its surrounding faces., Oct. 2011,.
(Continued)

*Primary Examiner* — Dieu Hien T Duong
(74) *Attorney, Agent, or Firm* — Perkins Coie LLP; Michael A. Glenn

(57) ABSTRACT

An antenna device includes a substrate having a first main side and a second main side located opposite the first main side, wherein a metallization is arranged, at least in portions, on the second main side of the substrate, wherein at least one flat antenna and at least one three-dimensional antenna are arranged on the first main side of the substrate, wherein the flat antenna extends, within a plane, in parallel with one of the two main sides of the substrate, and wherein the three-dimensional antenna is spaced apart, at least in portions, from the first main side of the substrate, and wherein the three-dimensional antenna and the flat antenna are galvanically connected to each other and a) include a shared signal
(Continued)

feeding portion or b) the three-dimensional antenna and the flat antenna are serially coupled.

21 Claims, 18 Drawing Sheets

(51) Int. Cl.

| | |
|---|---|
| ***H01Q 21/29*** | (2006.01) |
| ***H01Q 21/06*** | (2006.01) |
| ***H01Q 25/00*** | (2006.01) |
| ***H01Q 5/342*** | (2015.01) |
| ***H01Q 9/30*** | (2006.01) |
| *H01Q 15/02* | (2006.01) |

(52) U.S. Cl.
CPC ..... *H01Q 21/29* (2013.01); *H01Q 21/293* (2013.01); *H01Q 25/002* (2013.01); *H01Q 15/02* (2013.01)

(56) References Cited

U.S. PATENT DOCUMENTS

| | | | | |
|---|---|---|---|---|
| 6,618,012 | B1 | 9/2003 | Louzir et al. | |
| 2004/0219956 | A1* | 11/2004 | Iwai ..... | H01Q 1/24 455/575.3 |
| 2006/0028378 | A1 | 2/2006 | Gaucher et al. | |
| 2007/0026567 | A1 | 2/2007 | Beer et al. | |
| 2012/0299783 | A1 | 11/2012 | Lee et al. | |
| 2014/0253391 | A1* | 9/2014 | Yen ..... | H01Q 1/36 343/700 MS |

FOREIGN PATENT DOCUMENTS

| | | | |
|---|---|---|---|
| EP | 0163454 | A2 | 12/1985 |
| EP | 1596469 | A1 | 11/2005 |
| EP | 1845586 | A1 | 10/2007 |
| EP | 3453072 | A1 | 3/2019 |
| WO | 0145204 | A1 | 6/2001 |
| WO | 2017192881 | A1 | 11/2017 |

OTHER PUBLICATIONS

Ndip, et al., "Modelling the shape, length and radiation characteristics of bond wire antennas", IET Microwaves, Antennas & Propagation, The Institution of Engineering and Technology, United Kingdom, vol. 6, No. 10, Jul. 17, 2012, pp. 1187-1194.

Vandenbosch, et al., "Miniature Sensor Node with Conformal Phased Array", Radioengineering Journal, vol. 20, No. 4, This paper reports on the design and fabrication of a fully integrated antenna beam steering concept for wireless sensor nodes. The conformal array circumcises four cube faces with a silicon core mounted on each face., Dec. 2011, pp. 752-757.

Whyte, Griogair W., "Antennas for wireless sensor network applications", Ph.D. Dissertation, University of Glasgow, The objective of this thesis is to present an analysis of antennas, which are applicable to wireless sensor networks and, in particular, to the requirements of the Speckled Computing Network Consortium., 2008, 1-242.

* cited by examiner

NDIP ANTENNA

CROSS-REFERENCE TO RELATED APPLICATION

This application claims priority from German Patent Application No. DE 102017200129.1, which was filed on Jan. 5, 2017, and is incorporated herein in its entirety by reference.

The invention relates to an antenna device and in particular to an antenna device having at least one flat antenna and at least one three-dimensional antenna.

The inventive antenna device will also be referred to by Ndip antenna below, based on its inventor, Dr. Ivan Ndip.

BACKGROUND OF THE INVENTION

Conventional antennas such as monopole antennas, dipole antennas, patch antennas, bond-wire antennas, etc., irradiate the greater part of their energy mainly in an advantageous direction, i.e. either in the vertical direction (elevation plane) or in the horizontal direction (azimuthal plane).

For example, a patch antenna ranks among the directional flat antennas which irradiate the greater part of their energy in the vertical direction. A known patch antenna is depicted in FIG. 1A, for example. FIG. 1B shows the associated directional characteristic; it can be seen that only little radiation to no radiation at all is emitted within the horizontal plane (depicted by points A and B). For this reason communication within said plane is very difficult or not at all possible.

In order to bypass this problem, several solution concepts have already been proposed in conventional technology. For example, FIG. 1C depicts an antenna arrangement 5 known from conventional technology. Said antenna arrangement 5 comprises four individual flat antennas 1, 2, 3, 4 arranged symmetrically around a power distribution unit 6.

As can be seen in FIG. 1D, the four individual antennas 1, 2, 3, 4 are folded up into a cube, each of the four flat antennas forming one side of the cube. Thus, this antenna cube irradiates into the corresponding four directions.

However, what is disadvantageous about this is that the individual antennas are controlled among one another by means of electronic components such as phase shifters, or phase demodulators, switches and the like in order to be able to irradiate and receive, respectively, their powers into the advantageous directions without any mutual destructive interferences.

SUMMARY

According to an embodiment, an antenna device may have: a substrate including a first main side and a second main side located opposite the first main side, wherein a metallization is arranged, at least in portions, on the second main side of the substrate, wherein at least one flat antenna and at least one three-dimensional antenna are arranged on the first main side of the substrate, wherein the flat antenna extends, within a plane, in parallel with one of the two main sides of the substrate, and wherein the three-dimensional antenna is spaced apart, at least in portions, from the first main side of the substrate, and wherein the three-dimensional antenna and the flat antenna are galvanically connected to each other and a) include a shared signal feeding portion or b) the three-dimensional antenna and the flat antenna are serially coupled.

According to another embodiment, an antenna array may have: an inventive antenna device and, additionally, a second flat antenna arranged on the first main side of the substrate, as well as a three-dimensional antenna, wherein the second flat antenna extends, within a plane, in parallel with one of the two main sides of the substrate, and wherein the second three-dimensional antenna is spaced apart, at least in portions, from the first main side of the substrate, and wherein the second three-dimensional antenna and the second flat antenna are galvanically connected to each other and a) include a shared signal feeding portion or b) the second three-dimensional antenna and the second flat antenna are serially coupled.

The inventive antenna device (Ndip antenna) comprises a substrate comprising a first main side and a second main side located opposite the first main side, wherein a metallization is arranged, at least in portions, on the second main side of the substrate. At least one flat antenna is arranged on the first main side of the substrate. A flat antenna is an antenna whose length and width are clearly larger than its thickness. Flat antennas thus primarily extend within a plane, i.e. in at least two different spatial directions, e.g. in an x direction and a y direction. Flat antennas may include patch antennas, panel antennas and microstrip antennas, for example. Flat antennas are typically arranged on a substrate in a planar manner. They may also have a directional radiation pattern, the advantageous direction of the radiation typically being directed away from the surface of the flat antenna in the vertical direction. With the inventive antenna device, at least one three-dimensional antenna is additionally arranged on the first main side of the substrate. A three-dimensional antenna primarily extends within space in a three-dimensional manner, i.e. into at least one further spatial direction, e.g. a z direction, as compared to the flat antenna. The three-dimensional antenna thus extends at least into one of the two spatial directions (e.g. x direction and/or y direction) spanning the extension plane (e.g. x-y plane) of the flat antenna, and additionally into a further spatial direction (e.g. z direction) different therefrom. Thus, one can say that the flat antenna extends, within a plane, in parallel with one of the two main sides of the substrate, whereas the three-dimensional antenna is spaced apart, at least in portions, from the first main side of the substrate. In accordance with the invention, the three-dimensional antenna and the flat antenna are galvanically connected to each other. In accordance with a first case, the two antennas either comprise a shared signal feeding portion, or, in accordance with a second case, the two antennas are serially coupled. In both cases, both antennas are fed with the same signal. The advantage of this invention is that the radiation pattern of the flat antenna may be advantageously combined with the radiation pattern of the three-dimensional antenna. The flat antenna advantageously irradiates into the direction which is vertical (with regard to the substrate plane), whereas the three-dimensional antenna advantageously irradiates into the direction which is horizontal (with regard to the substrate plane). In accordance with the invention, both antennas here are combined such that the radiation coupling between the two antennas is smallest where they have their extreme field strength values. For example, one of the two antennas has a maximum current intensity where the other one of the two antennas has a minimum current intensity. Thus, minimum mutual radiation coupling of the two antennas results. Accordingly, a constructive interference rather than a destructive interference will occur. Such a suitable combination may be influenced, e.g., by suitably selecting the geometric lengths of the two antennas.

BRIEF DESCRIPTION OF THE DRAWINGS

Embodiments of the present invention will be detailed subsequently referring to the appended drawings, in which.

DETAILED DESCRIPTION OF THE INVENTION

Figure 1B:
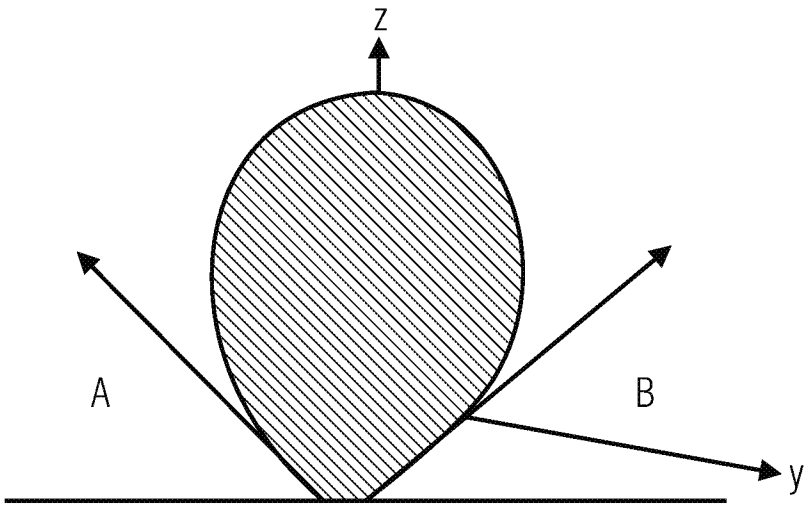
Fig. 1B (PRIOR ART)
FIG. 1B shows a directional characteristic of the patch antenna of FIG. 1A.
Figure 1A:
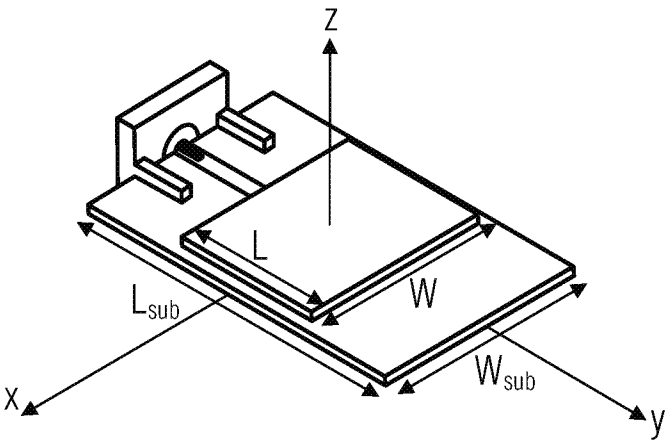
Fig. 1A (PRIOR ART)
FIG. 1A shows a perspective view of a known patch antenna of conventional technology.
Figure 1D:
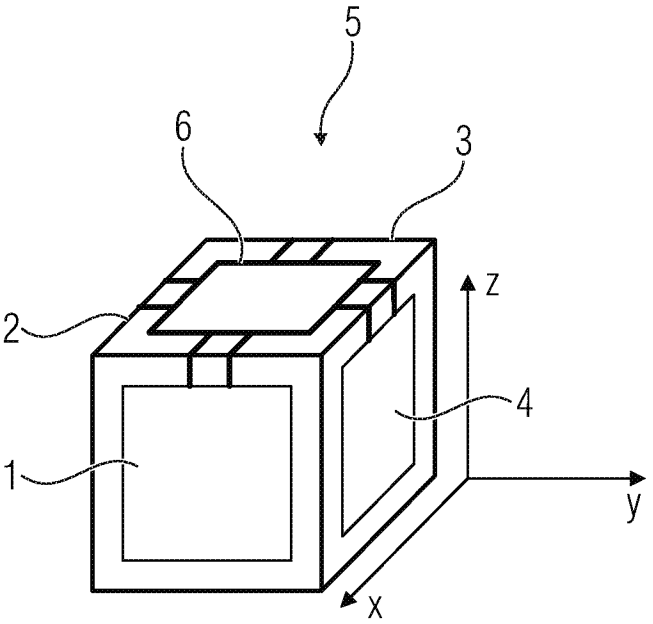
Fig. 1D (PRIOR ART)
FIG. 1D shows a perspective view of the composed three-dimensional antenna of FIG. 1C.
Figure 1C:
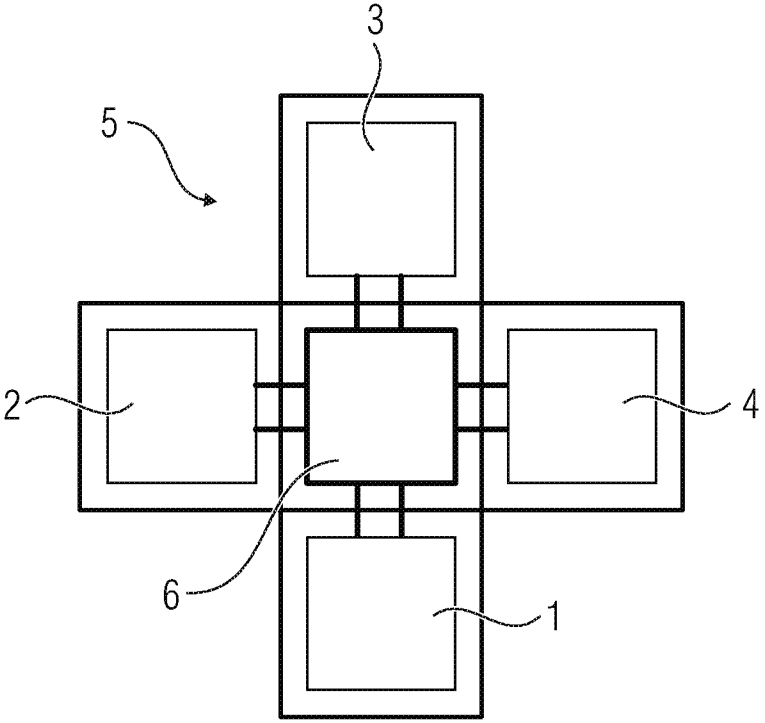
Fig. 1C (PRIOR ART)
FIG. 1C shows a top view of a planarly spread-out three-dimensional antenna of conventional technology.

Advantageous embodiments of the invention will be described in more detail below with reference to the figures, wherein elements having identical or similar functions will be provided with identical reference numerals. The inventive antenna device 10 will also be referred to below as an Ndip antenna on the basis of its inventor, Dr. Ivan Ndip.

Figure 2A:
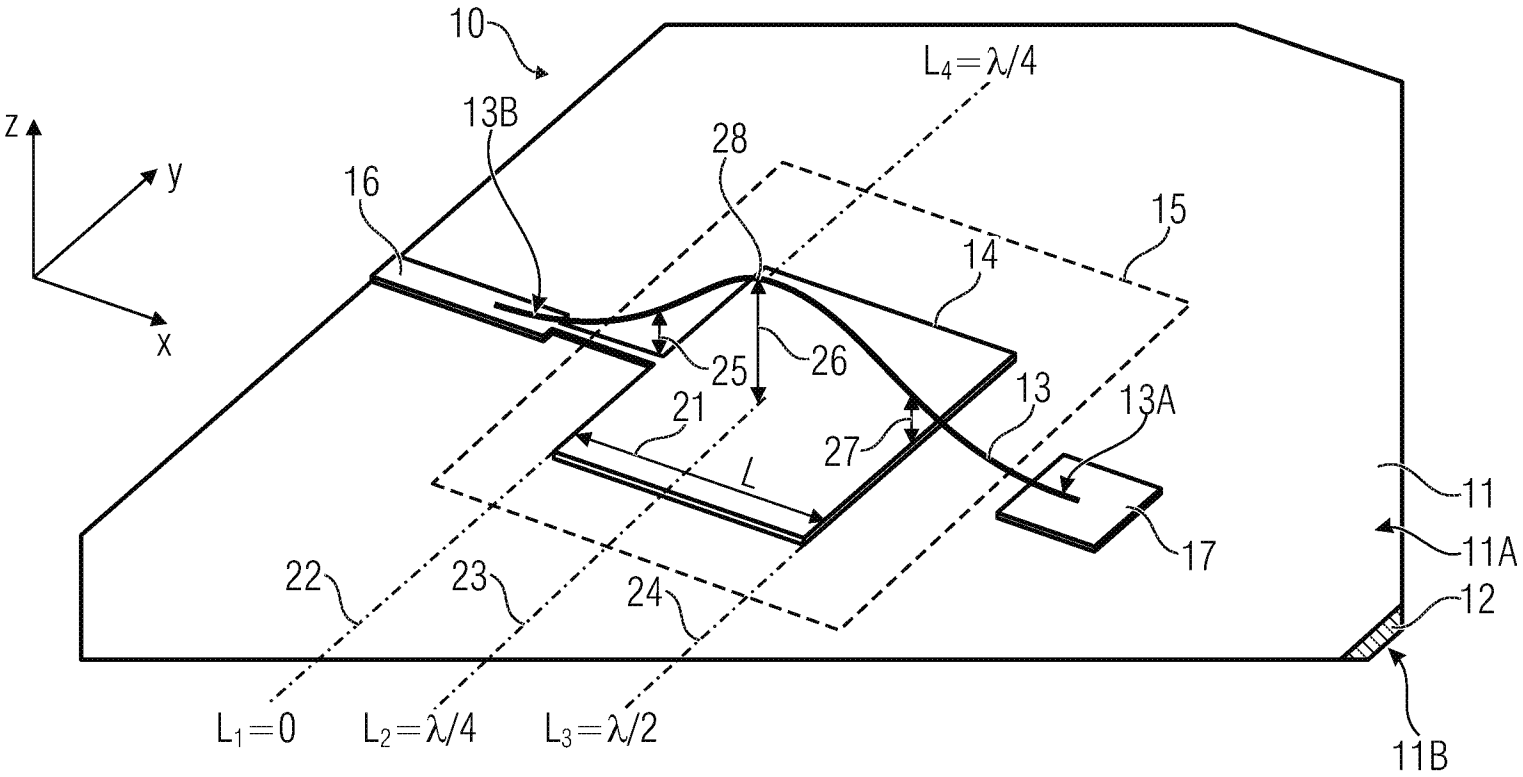
FIG. 2A shows a perspective view of an inventive Ndip antenna in accordance with a first embodiment.
Figure 2B:
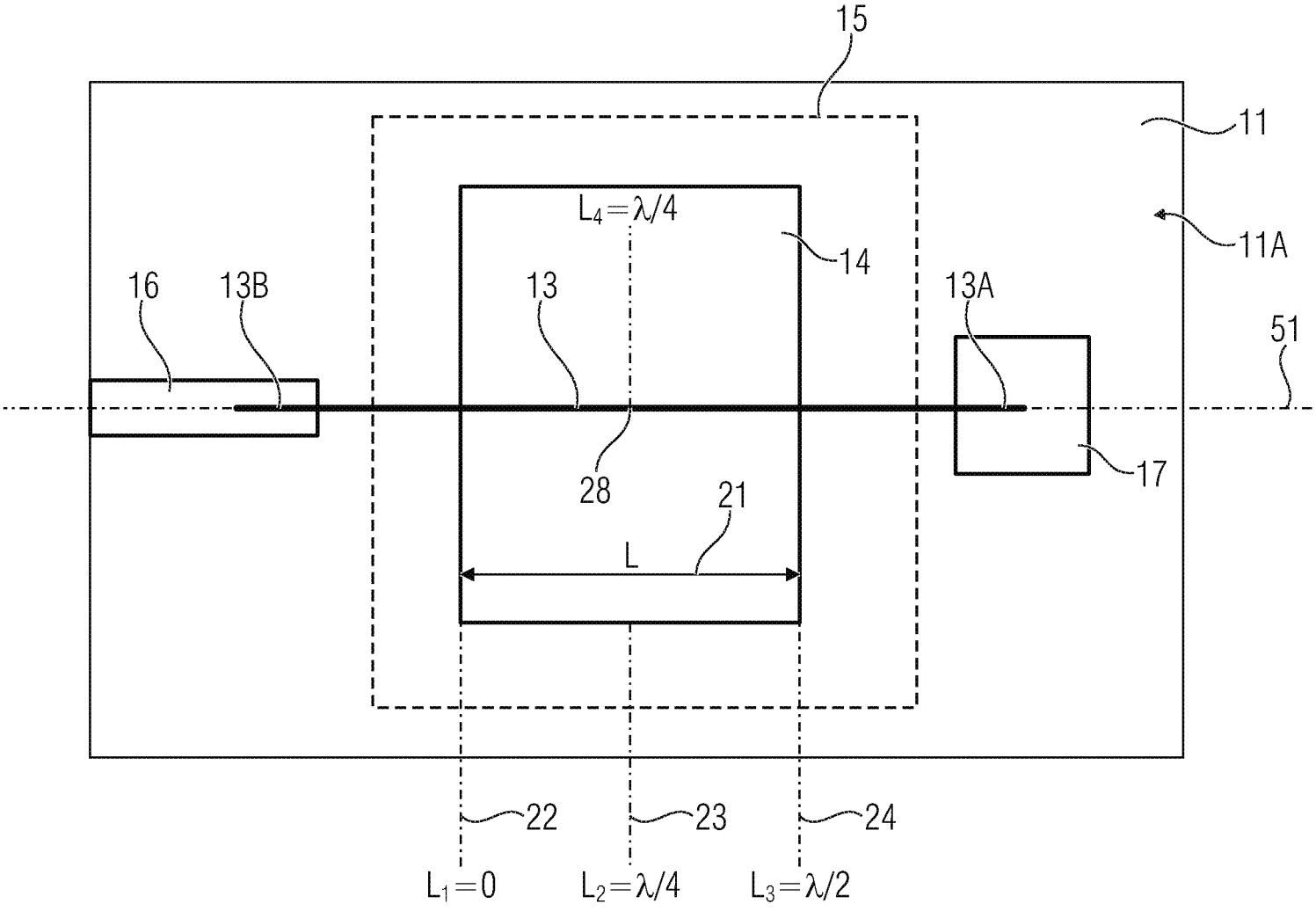
FIG. 2B shows a top view of the Ndip antenna of FIG. 2A.

FIGS. 2A and 2B show an inventive Ndip antenna 10 in accordance with a first embodiment. The Ndip antenna 10 comprises a substrate 11 having a first main side 11A and a second main side 11B located opposite the first main side 11A.

The second main side 11B of the substrate 11 has, at least in portions, a metallization 12 arranged thereon.

The first main side 11A of the substrate 11 has at least one flat antenna 14 and at least one three-dimensional antenna 13 arranged thereon. The flat antenna 14 may be a patch antenna, for example. The three-dimensional antenna 13 may be a ribbon-bond antenna, for example. In the embodiment depicted in FIGS. 2A and 2B, the three-dimensional antenna 13 is a thin wire, e.g. a bond wire.

The flat antenna 14 extends, within a plane 15, in parallel with one of the two main sides 11A, 11B of the substrate 11. This means that the flat antenna 14 is planarly arranged on the surface of the first main side 11A of the substrate. Put differently, the substrate 11 as well as the flat antenna 14 arranged thereon extend within an X-Y plane with regard to the coordinate system drawn in, it being possible for the flat antenna 14 to advantageously be arranged on the substrate 11 along the entire first main side 11A of the substrate 11.

At least portions of the three-dimensional antenna 13 are spaced apart from the first main side 11A of the substrate 11. This means that the three-dimensional antenna 13 extends from a first point 13A located on the surface of the first main side 11A of the substrate 11 to a second point 13B located on the surface of the first main side 11A of the substrate and is spaced apart, between said two points 13A, 13B, from the surface of the first main side 11A of the substrate 11. Here the three-dimensional antenna 13 is spaced apart from the flat antenna 14, or from the surface of the first main side 11A of the substrate 11, in the vertical direction, or in a Z direction in relation to the coordinate system drawn in.

The three-dimensional antenna 13 and the flat antenna 14 are symmetrically arranged along a shared straight line 51. The shared straight line 51 extends in parallel with the three-dimensional antenna 13 and, in particular, the three-dimensional antenna 13 is located precisely on said shared straight line 51. In addition, the shared straight line 51 extends on-center through the flat antenna 14.

The three-dimensional antenna 13 and the flat antenna 14 are galvanically connected to each other. In the embodiment depicted in FIGS. 2A and 2B, the three-dimensional antenna 13 and the flat antenna 14 comprise a shared signal feeding portion 16. The three-dimensional antenna 13 and the flat antenna 14 are galvanically connected to each other at said signal feeding portion 16.

A signal is fed in at the shared signal feeding portion 16, so that the same signal is applied both at the flat antenna 14 and at the three-dimensional antenna 13. In this configuration, the flat antenna 14 and the three-dimensional antenna 13 are connected in parallel with each other.

Alternative embodiments of the invention provide for the two antennas 13, 14 to be serially coupled. Corresponding embodiments will be explained in more detail below with reference to FIGS. 5A, 5B and 5C.

However, the invention is initially to be described by means of continued reference to FIGS. 2A and 2B.

As can be seen, a first fastening area 17 is arranged on the first main side 11A of the substrate 11. The three-dimensional antenna 13 comprises a first mounting portion 13A by means of which the three-dimensional antenna 13 is galvanically connected to the first fastening area 17. The fastening area 17 may be a bond pad, for example. The first mounting portion 13A of the three-dimensional antenna 13 is mechanically fastened to said fastening area 17.

In addition, the three-dimensional antenna 13 comprises a second mounting portion 13B which galvanically and mechanically connects the three-dimensional antenna 13 to the shared signal feeding portion 16. Alternatively, the second mounting portion 13B may also serve to galvanically and mechanically connect the three-dimensional antenna 13 to the flat antenna 14, as shown in FIG. 5C, for example.

In the embodiment depicted in FIGS. 2A and 2B, the first and second mounting portions 13A, 13B of the three-dimensional antenna 13 are the respective ends, or tips, of the bond wire 13. The bond wire 13 thus is arranged, with its two wire ends, or wire tips, 13A, 13B, on the flat antenna 14 and on the fastening area 17.

The first fastening area 17 is arranged, in relation to the flat antenna 14, opposite the shared signal feeding portion 16, the three-dimensional antenna 13 extending at least in portions across the flat antenna 14, between the shared signal feeding portion 16 and the first fastening area 17, while being spaced apart from the flat antenna 14 in a Z direction, i.e., orthogonally to the substrate plane (=X-Y plane).

One may therefore say that the three-dimensional antenna 13 extends across the entire flat antenna 14 at a distance from the flat antenna 14. In the embodiment depicted, the three-dimensional antenna 13 extends across the flat antenna 14 in an arch-shaped manner.

The flat antenna 14 comprises a geometric length L characterized by reference numeral 21 in FIGS. 2A and 2B. Various positions 22, 23, 24 are drawn in orthogonally to the current flow direction, or to a main extension direction 21 of the flat antenna 14, at which positions 22, 23, 24 the geometric length L of the flat antenna is indicated as a function of the wavelength λ of the fed signal.

For example, the straight line 22 marks a position $L_1$ where the geometric length of the flat antenna 14 equals zero ($L_1$=0). The straight line 23 marks a position $L_2$ where the geometric length of the flat antenna corresponds to a wavelength of $$L_2 = \frac{\lambda}{4}.$$

The straight line 24 marks a position $L_3$ where the geometric length of the flat antenna 14 corresponds to a wavelength of $$L_3 = \frac{\lambda}{2}.$$

As can be seen, in particular, in FIG. 2A, the three-dimensional antenna 13 comprises, approximately at the center, a first distance 26 which is vertical, i.e., which is directed orthogonally to the substrate plane 15, from the first main side 11A of the substrate 11. Since the three-dimensional antenna 13 extends across the flat antenna 14 in an arch-shaped manner, as was mentioned at the outset, the three-dimensional antenna 13 has a second vertical distance 25 and a third vertical distance 27 on the left and on the right of its center, respectively.

More specifically, the three-dimensional antenna 13 comprises, at a position corresponding to a geometric length of $$L_2 = \frac{\lambda}{4}$$

of the flat antenna, a first distance 26 from the flat antenna 14 which is directed orthogonally to the substrate plane. In addition, the three-dimensional antenna 13 comprises, at a position corresponding to a geometric length of $$L_1 = 0 \text{ or } L_3 = \frac{\lambda}{2}$$

of the flat antenna 14, second and third distances 25, 27, respectively, from the flat antenna 14 which are directed orthogonally to the substrate plane, the amount of the first distance 26 exceeding the amount of the second and third distances 25, 27, respectively.

The three-dimensional direction 13 has a total length of $$L_{3D} = \frac{\lambda}{2}, \text{ i.e.,}$$

in this embodiment, the three-dimensional antenna 13 is a λ/2 radiator. Thus, the three-dimensional antenna 13 has a geometric length of $$L_4 = \frac{\lambda}{4}$$

approximately at the center 28 of its total length of $$L_{3D} = \frac{\lambda}{2}.$$

As can be seen in FIGS. 2A and 2B, the center 28 of the three-dimensional antenna 13, i.e., that point 28 where the three-dimensional antenna 13 has a geometric length of $$L_4 = \frac{\lambda}{4},$$

is located opposite that point where the flat antenna 14 has a geometric length of $$L_2 = \frac{\lambda}{4}.$$

This means that the three-dimensional antenna 13 and the flat antenna 14 are mutually aligned to be located opposite each other precisely where both antennas 13, 14 each have a geometric length of $$L_2 = L_4 = \frac{\lambda}{4}.$$

In addition, it is precisely at this point that the three-dimensional antenna 13 may have the largest vertical distance 26 from the flat antenna 14.

With the inventive Ndip antenna 10, generally, at least the flat antenna 14 or at least the three-dimensional antenna 13 may be galvanically or capacitively coupled to the metallization 12 located on the second main side 11B of the substrate 11.

In other words, either the flat antenna 14 or the three-dimensional antenna 13 may be coupled to the metallization 12, or both the flat antenna 14 and the three-dimensional antenna 13 may be coupled to the metallization 12.

Figure 2C:
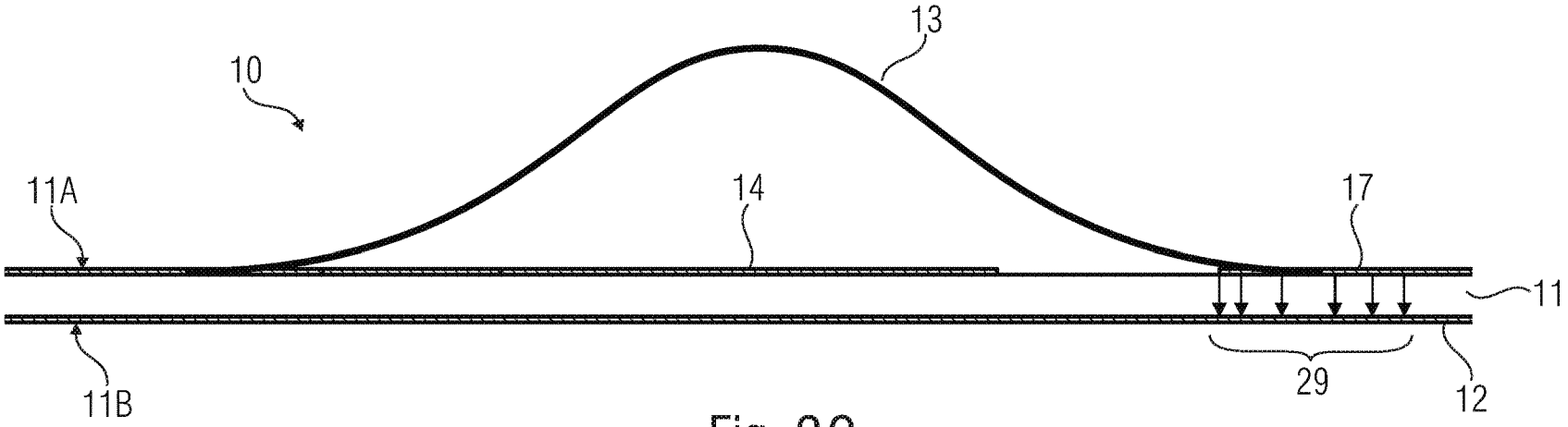
FIG. 2C shows a side view of an inventive Ndip antenna with capacitive coupling between the three-dimensional antenna and the backside metallization.

Said coupling may be a capacitive coupling, for example, as depicted in FIG. 2C. In this case, the respective antenna 13, 14 might be capacitively coupled to the metallization 12 located on the second main side 11B of the substrate 11 because of the displacement current density 29 extending through the dielectric substrate 11. Said capacitive coupling, or the quality of said capacitive coupling, is dependent on the frequency of the fed signal.

Figure 2D:
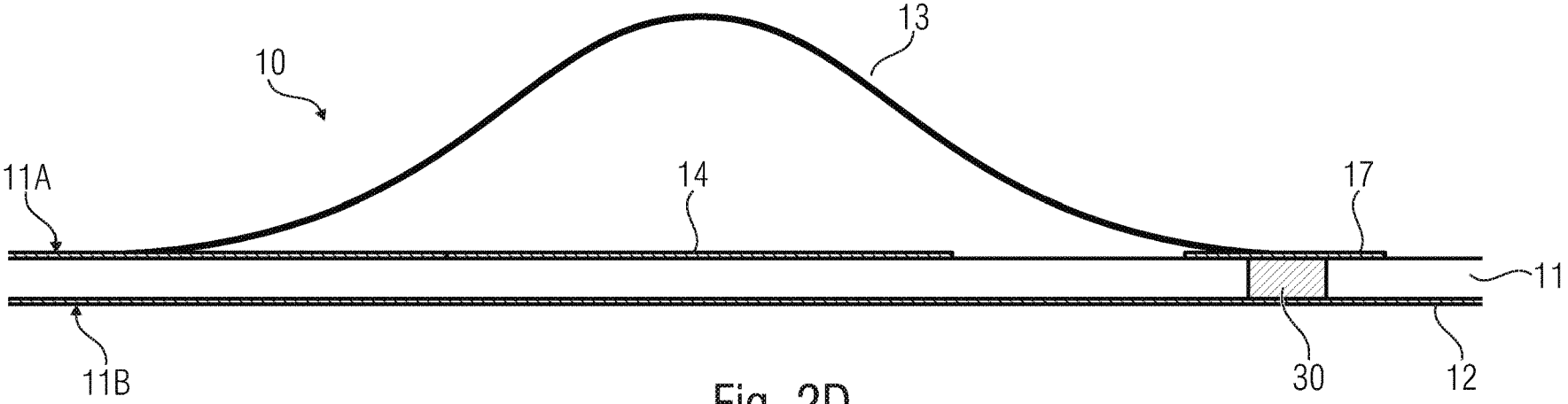
FIG. 2D shows a side view of an inventive Ndip antenna with galvanic coupling between the three-dimensional antenna and the backside metallization by means of a via.

However, said coupling may also be a galvanic coupling, for example, as depicted in FIG. 2D. In this case, the respective antenna 13, 14 might be galvanically coupled to the metallization 12, e.g., by a via 30 extending through the substrate 11.

In the embodiment depicted in FIGS. 2A and 2B, the fastening area 17 is capacitively coupled to the metallization 12.

If the three-dimensional antenna 13 is galvanically connected to the fastening area 17, the three-dimensional antenna 13 will therefore also be electrically coupled to the metallization 12.

Figure 3:
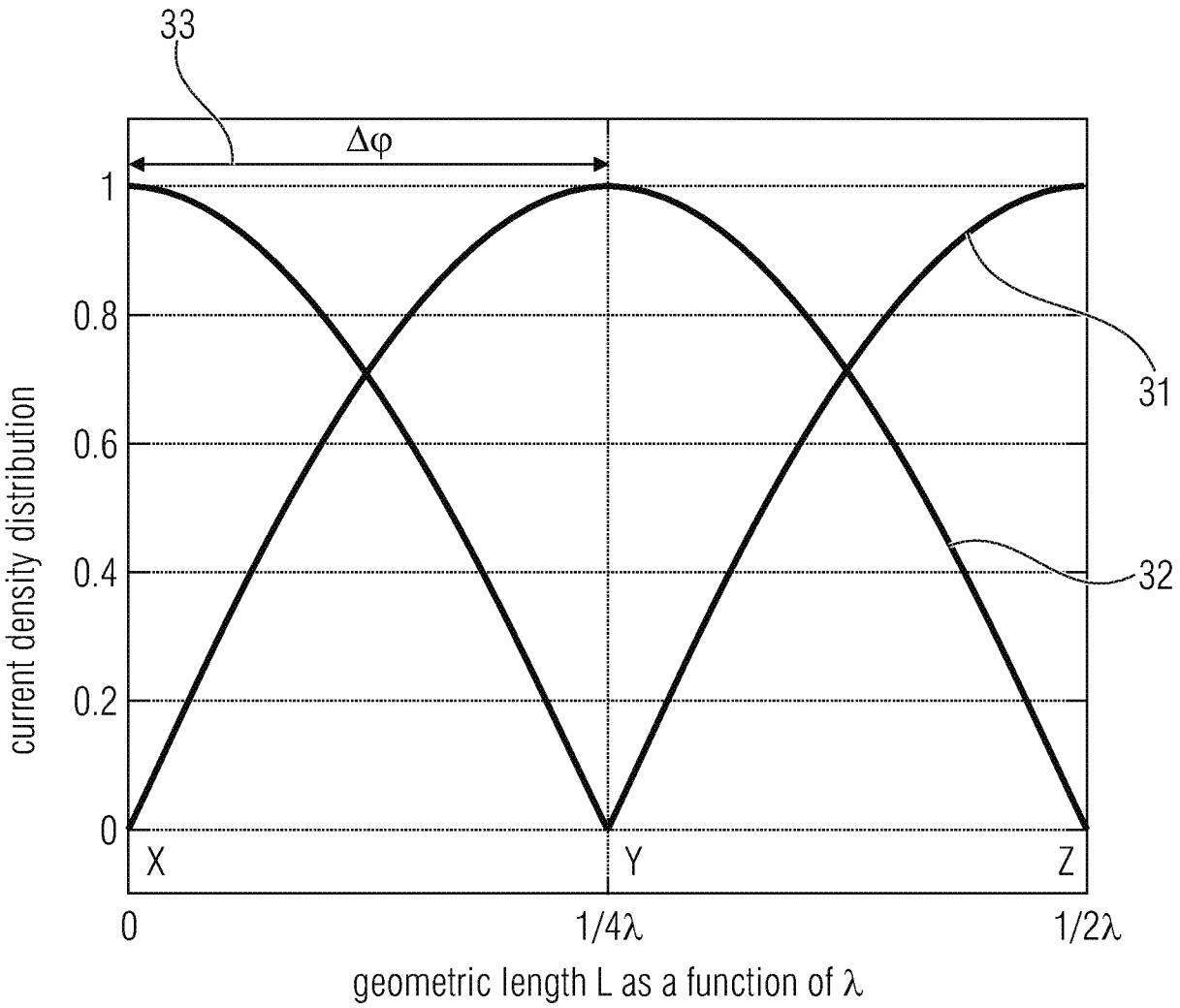
FIG. 3 shows a diagram depicting the current density distribution of a three-dimensional antenna and of a flat antenna, both of which are parts of the inventive Ndip antenna.

The metallization 12 may serve as a reflector. However, the metallization 12 may also serve as a current-carrying return line. FIG. 3 shows an approximated schematic representation of the current path, or of the current density distribution, along an antenna 13, 14 across its geometric length L as a function of the wavelength λ of a shared radio signal. The diagram depicts the waveform at both antennas 13, 14 shown in FIG. 2A, both antennas 13, 14 being fed with the same signal.

Curve 31 depicts an approximated current path within the three-dimensional antenna 13. The curve 32 represents an approximated current path within the flat antenna 14.

Since the three-dimensional antenna 13 is short-circuited, or terminated, its current path 31 is proportional to the amount of the cosine function $$\left|\cos\frac{2\pi L_{3D}}{\lambda}\right|,$$

wherein $L_{3D}$ is the geometric length, plotted on the x axis, of the three-dimensional antenna 13 as a function of the wavelength λ.

Since the flat antenna 14 is not terminated, by contrast, its current path 32 is proportional to the amount of the sine function $$\left|\sin\frac{2\pi L_{FLAT}}{\lambda}\right|,$$

wherein $L_{FLAT}$ is the geometric length, plotted on the x axis, of the three-dimensional antenna 13 as a function of the wavelength λ.

As can be seen in the diagram shown in FIG. 3, the curve 31 has a maximum current intensity at the point L=0. However, the curve 32 exhibits a minimum current intensity at this point L=0. At the point $$L = \frac{\lambda}{4},$$

this relationship is inverted, i.e., the curve 31 here exhibits a minimum current intensity, whereas the curve 32 here exhibits a maximum current intensity. At the point $$L = \frac{\lambda}{2},$$

this relationship is inverted once again, i.e., the curve 31 here exhibits a maximum current intensity, whereas the curve 32 here exhibits a minimum current intensity. Therefore, constructive interferences arise.

In slightly more general terms, one may state that the flat antenna 14 and the three-dimensional antenna 13 each comprise a geometric length $L_{3D}$, $L_{FLAT}$, at which, when the flat antenna 14 and the three-dimensional antenna 13 are fed with the same signal, a current density distribution in the form of a standing wave 32 occurs along the geometric length $L_{FLAT}$ of the flat antenna 14, said current density distribution exhibiting a phase offset 33 in relation to a current density distribution which occurs within the three-dimensional antenna 13 in the form of a standing wave 31 along the geometric length $L_{3D}$ of the three-dimensional antenna 13, the phase offset amounting to $|\Delta\varphi=90°|\pm20\%$ or $|\Delta\varphi=90°|\pm10\%$ and advantageously 90°.

In order to ensure that the radiation pattern of the inventive Ndip antenna 10 represents a true hybrid of both individual antennas 13, 14, the three-dimensional antenna 13 and the flat antenna 14 are combined such that coupling between the two antennas 13, 14 will be at a minimum at those points where they have their respective maximum field strength values. This will then result in constructive interference as shown in FIG. 3.

For example, the three-dimensional antenna 13 and the flat antenna 14, which are depicted in FIG. 2A, may be two resonant antennas. This means that the flat antenna 14 is tuned to a first resonant frequency, and the three-dimensional antenna 13 is tuned to a second resonant frequency. The two resonant frequencies are advantageously identical.

However, the two resonant frequencies may also have a certain tolerance range, i.e., the first and second resonant frequencies may slightly deviate from each other. In accordance with one embodiment of the Ndip antenna, the first and second resonant frequencies here deviate from each other by less than 5%. The smaller the deviation, the larger the antenna gain that may be achieved with the Ndip antenna.

In accordance with a different embodiment, the first and second resonant frequencies deviate from each other by 5% or more. In accordance with a conceivable embodiment, the first and second resonant frequencies here deviate from each other by less than 30% at the same time. In this manner, a broadband characteristic of the Ndip antenna may be achieved, i.e., the larger the deviation of the first and second resonant frequencies, the larger the achievable broadband spectrum will be. It is possible, so to speak, to implement a multiband Ndip antenna.

In accordance with the above description, both antennas 13, 14 are combined with each other such that their mutual coupling is at a minimum at $$L = 0, \text{ at } L = \frac{\lambda}{4} \text{ and at } L = \frac{\lambda}{2}.$$

If the above-mentioned criteria in combining the flat antenna 14 with the three-dimensional antenna 13 are met, the respective radiation patterns of both said antennas 13, 14 may be combined in an optimum manner. In addition, no expensive circuits and/or phase shifters may be used in order to adapt the phase positions of both antenna signals 31, 32.

Therefore, both antennas 13, 14 have as little influence on each other as possible, so that the waveform, depicted in FIG. 3, having a phase offset of 90° results, or in other words, when the radiation coupling of both antennas 13, 14 is at a minimum where one of both antennas 13, 14 exhibits its maximum power.

In accordance with embodiments of the invention, the three-dimensional antenna 13 and the flat antenna 14 are configured such that both the geometric length $L_{FLAT}$ of the flat antenna 14 and the geometric length $L_{3D}$ of the three-dimensional antenna 13 each correspond to an integer multiple of $$\frac{\lambda}{4}.$$

In this case, both antennas 13, 14 will have as little influence on each other as possible when the radiation coupling at the points $$L = 0, \text{ at } L = \frac{\lambda}{4} \text{ and at } L = \frac{\lambda}{2}$$

is at a minimum.

If the criterion underlying the invention is met, therefore, the combination of the radiation patterns of both antennas 13, 14 to form a total radiation pattern of the inventive Ndip antenna 10 is particularly advantageous.

To illustrate this, the radiation patterns depicted in FIGS. 4A, 4B, 4C and 4D shall be addressed below.

Figure 4A:
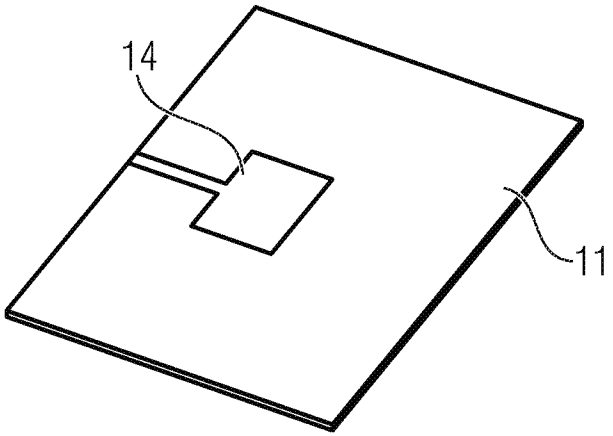
FIG. 4A shows a flat antenna and the associated antenna pattern.
Figure 4A:
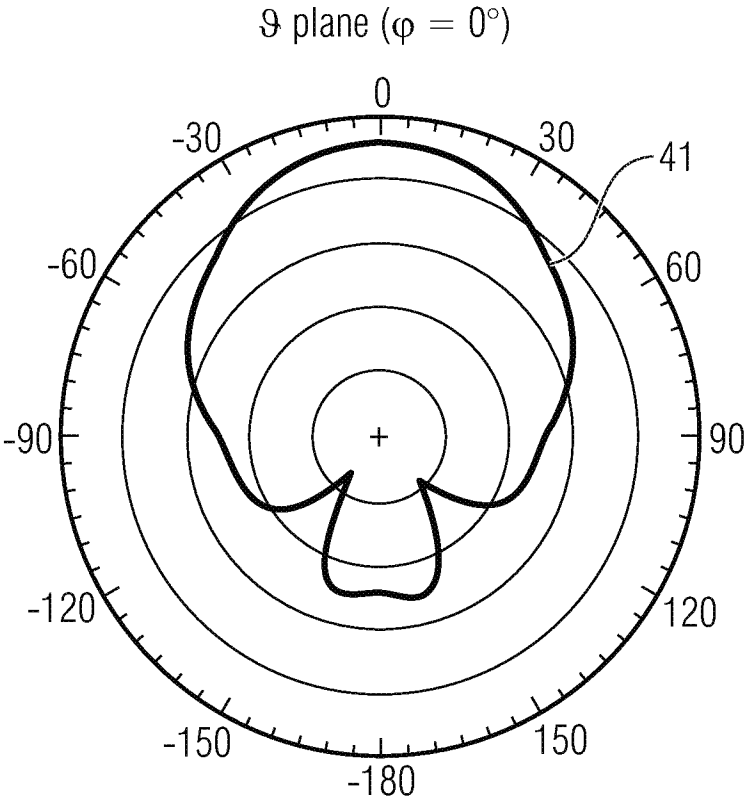

FIG. 4A shows a patch antenna 14 arranged on a substrate 11. The adjacent diagram depicts the radiation pattern of said patch antenna 14. It can be seen here that the main lobe 41 extends essentially vertically upward, i.e., away from the substrate 11.

Figure 4B:
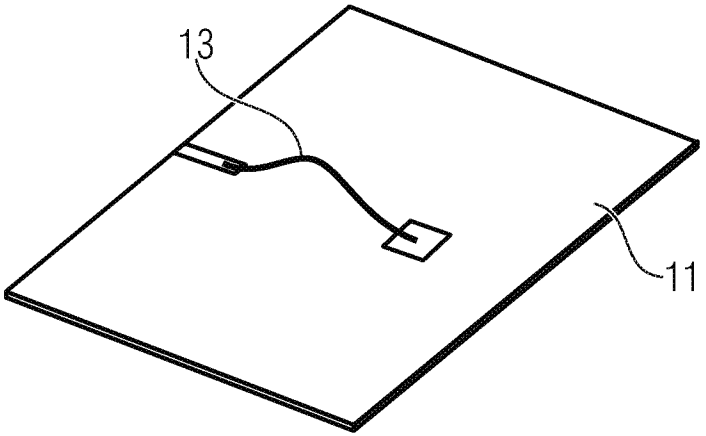
FIG. 4B shows a three-dimensional antenna and the associated antenna pattern.
Figure 4B:
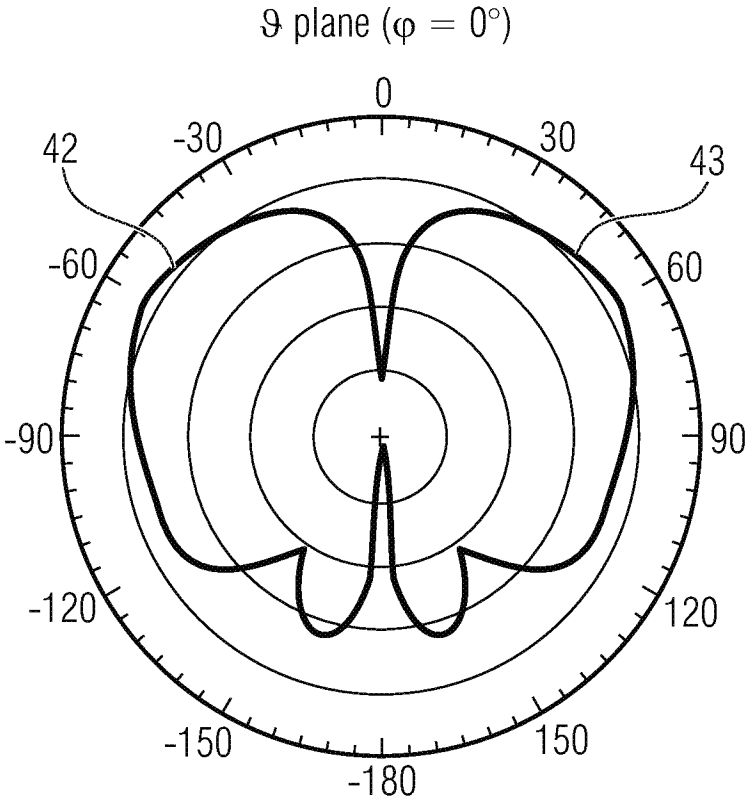

FIG. 4B shows a three-dimensional bond wire antenna 13 arranged on a substrate 11. The adjacent diagram depicts the radiation pattern of this bond wire antenna 13. Here one can see that two roughly kidney-shaped main lobes 42, 43 propagate essentially within the horizontal plane, i.e., along the substrate plane.

Figure 4C:
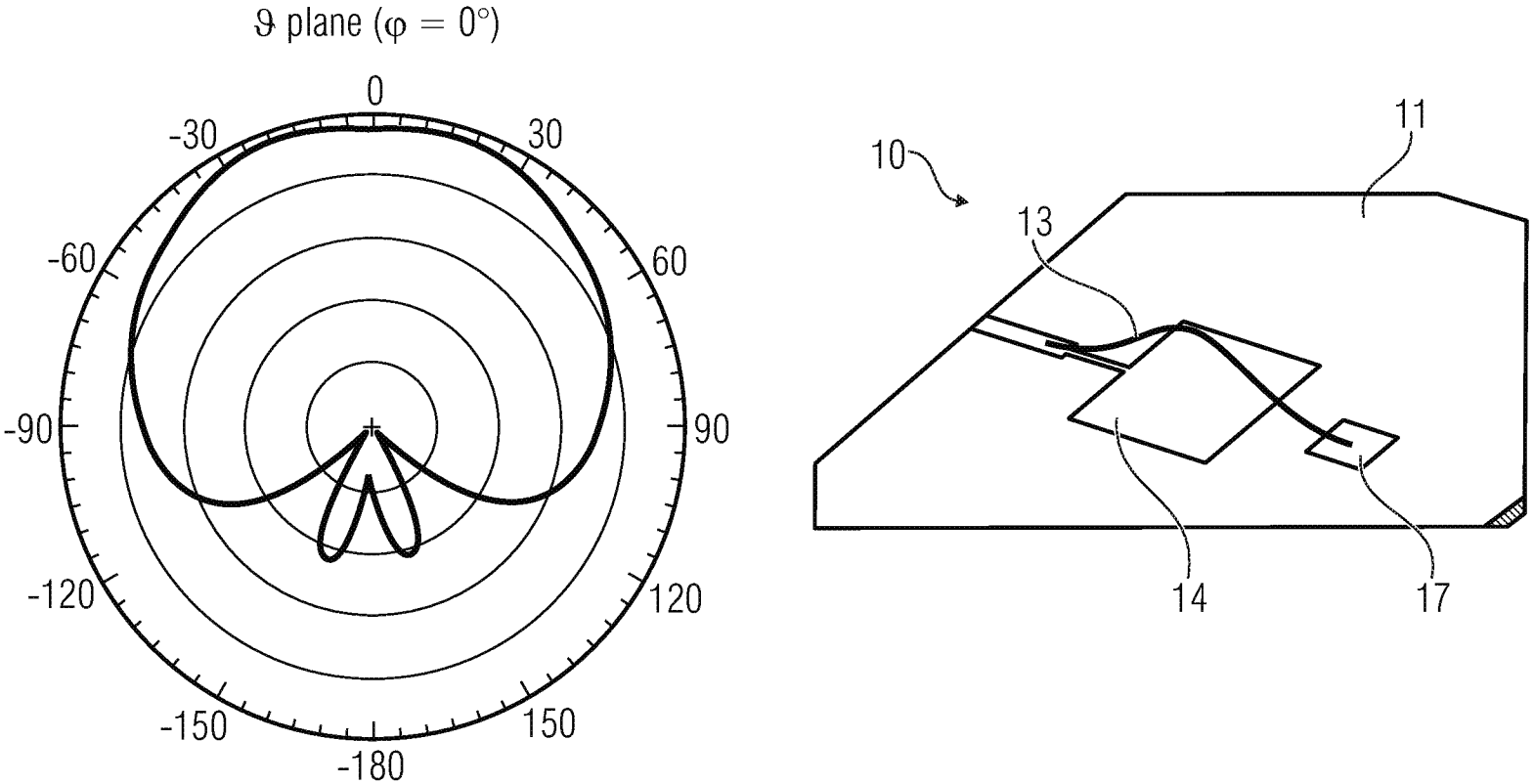
FIG. 4C shows an inventive Ndip antenna and the associated antenna pattern.

FIG. 4C shows an inventive Ndip antenna 10, as previously described with reference to FIG. 2A, comprising a flat antenna 14 and a three-dimensional antenna 13. The adjacent diagram depicts the radiation pattern of the Ndip antenna 10.

Figure 4D:
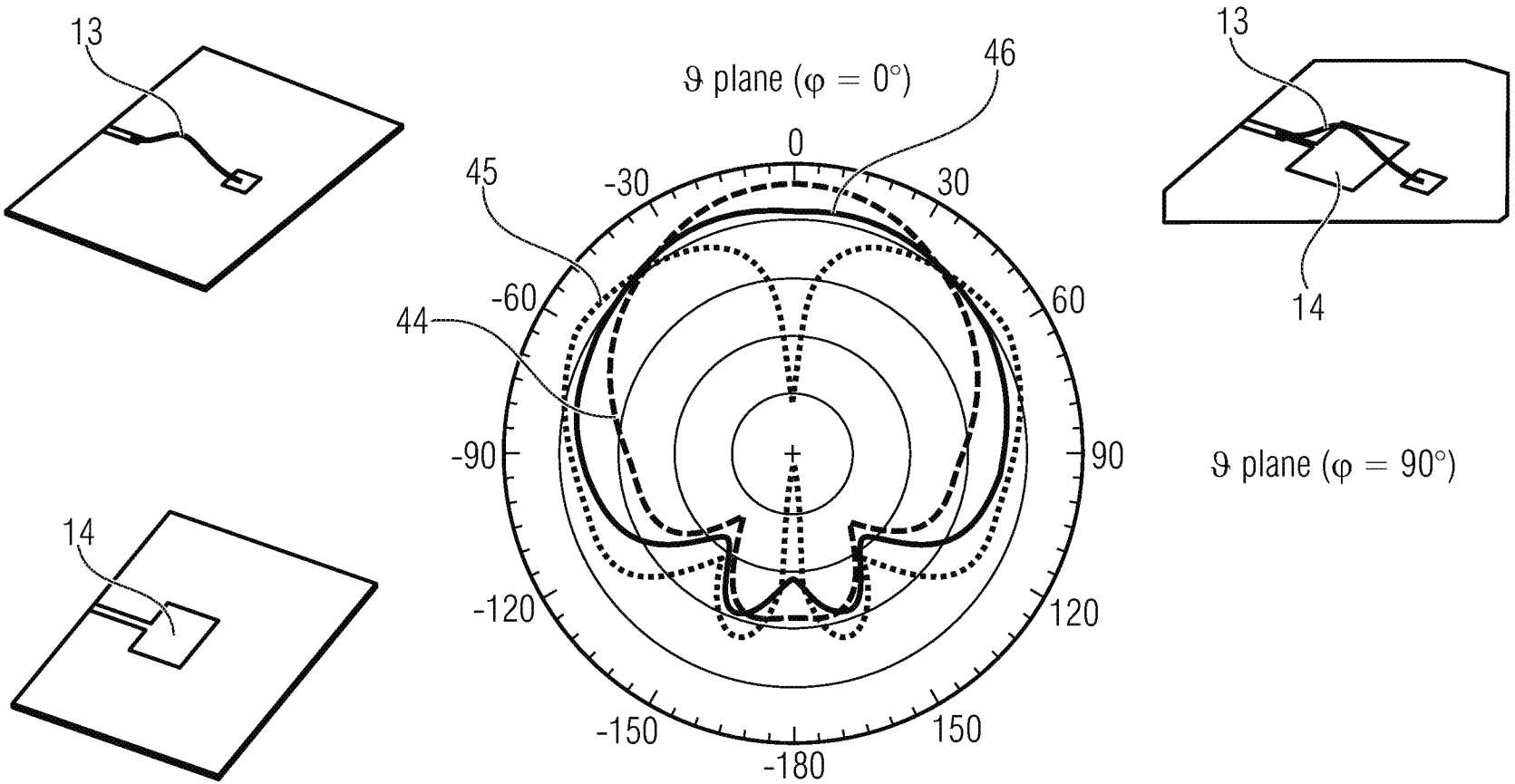
FIG. 4D shows an overview of the antenna patterns of a three-dimensional antenna, of a flat antenna and of an inventive Ndip antenna.

To provide a graphic comparison, FIG. 4D depicts the above-mentioned radiation patterns in a shared diagram. Here, curve 44 represents the radiation pattern of the flat antenna 14, curve 45 represents the radiation pattern of the three-dimensional antenna 13, and curve 46 represents the radiation pattern of the inventive Ndip antenna 10.

Curve 44 shows the radiation pattern of a flat antenna 14. One can see the above-mentioned main lobe, which advantageously extends in a vertical direction.

Curve 45 shows the radiation pattern of a three-dimensional antenna 13. One can see the above-mentioned kidney-shaped main lobe, which propagates advantageously horizontally along the substrate plane.

Curve 46 shows the radiation pattern of the inventive Ndip antenna 10. One can see that irradiation occurs both in the vertical direction and in the horizontal direction along the substrate plane. The inventive Ndip antenna 10 thus achieves a radiation pattern which is clearly superior to the radiation patterns of the individual antennas 13, 14, specifically in such a manner that both antennas 13, 14 have as little influence as possible on each other while the signals of both antennas 13, 14 superimpose one another in as constructive a manner as possible.

In addition to the embodiments previously described in FIG. 4C and with reference to FIG. 2A, further embodiments of the inventive Ndip antenna 10 are conceivable. Said further embodiments shall be described below with reference to FIGS. 5A to 5D, FIGS. 5A, 5B and 5C depicting a series connection of the three-dimensional antenna 13 to the flat antenna 14.

Figure 5A:
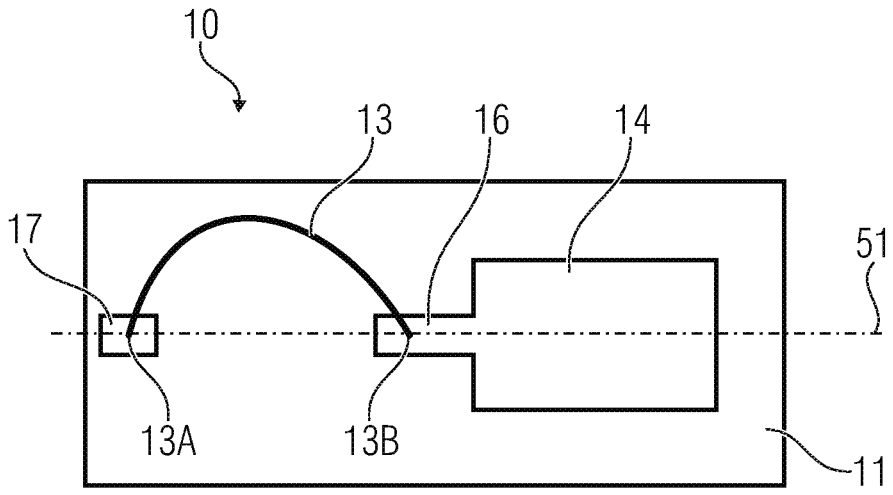
FIG. 5A shows a top view of an inventive Ndip antenna in accordance with an embodiment.

FIG. 5A shows an Ndip antenna 10 comprising a flat antenna 14 arranged on a substrate 11, and a three-dimensional antenna 13 arranged on the substrate 11. Both antennas 13, 14 are connected to each other at a shared signal feeding portion 16. A first end 13A, or a first mounting portion 13A, of the three-dimensional antenna 13 is arranged on a first fastening area 17 arranged on the substrate 11, and an opposite second end 13B, or a second mounting portion 13B, of the three-dimensional antenna 13 is arranged on the shared signal feeding portion 16.

The first mounting portion 13A of the three-dimensional antenna 13 may be mechanically, and optionally galvanically, coupled to the first fastening area 17. The second mounting portion 13B of the three-dimensional antenna 13 may be mechanically, and optionally galvanically, coupled to the shared signal feeding portion 16.

In accordance with this embodiment, the first fastening area 17 is arranged, in relation to the signal feeding portion 16, opposite the flat antenna 14, so that the signal feeding portion 16 is spatially arranged between the first fastening area 17 and the flat antenna 14, the first fastening area 17, the signal feeding portion 16 and the flat antenna 14 all being arranged along a shared straight line 51.

Figure 5B:
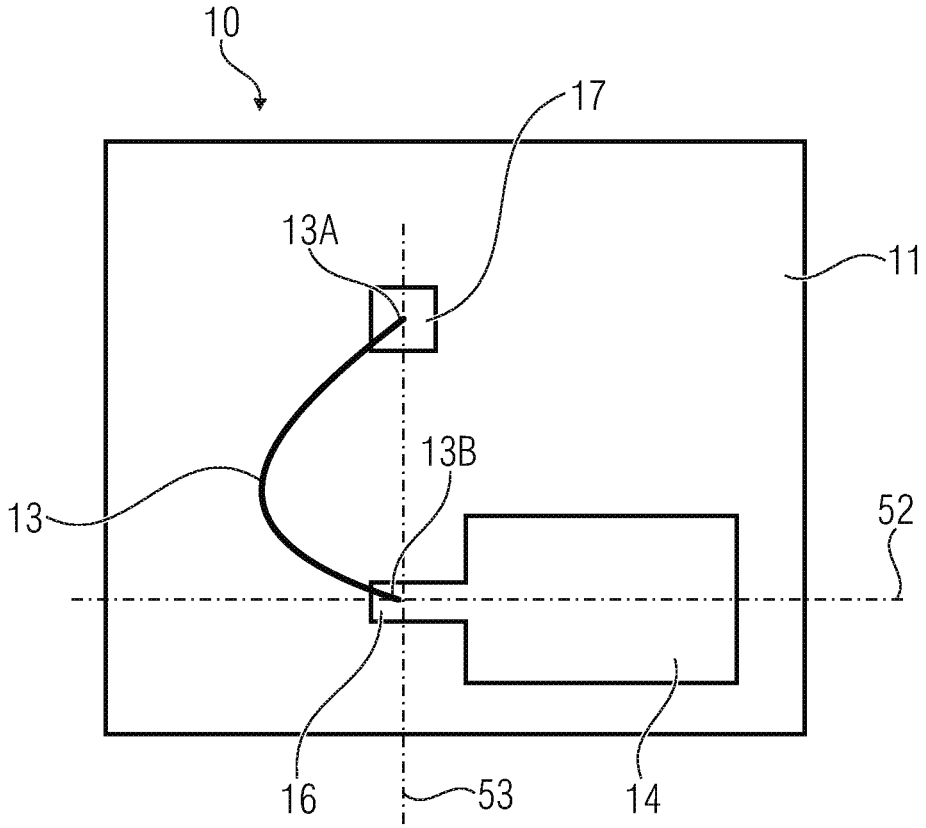
FIG. 5B shows a top view of an inventive Ndip antenna in accordance with a further embodiment.
Figure 5C:
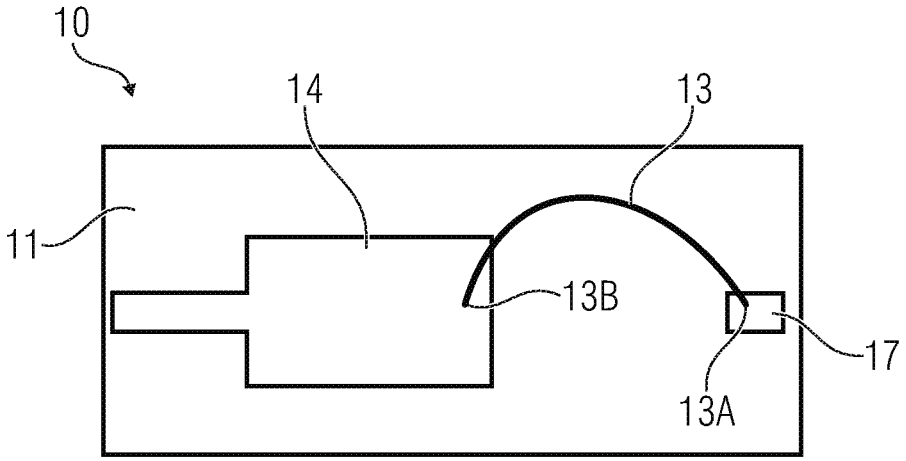
FIG. 5C shows a top view of an inventive Ndip antenna in accordance with a further embodiment.

FIG. 5B shows a further embodiment. Said embodiment differs from the embodiment previously described with reference to FIG. 5A in that the first fastening area 17 is arranged to be offset by 90°.

In the embodiment depicted in FIG. 5B, therefore, the flat antenna 14 and the shared signal feeding portion 16 are arranged along a first shared straight line 52, and the first fastening area 17 and the shared signal feeding portion 16 are arranged along a second shared straight line 53, the first shared straight line 52 and the second shared straight line 53 extending orthogonally to each other.

In principle, the second fastening area 17, or the first mounting portion 13A, which is not arranged on the shared signal feeding portion 16, of the three-dimensional antenna 13 may be arranged at any location on the substrate 11, i.e., may be arranged within a range of 360° around the flat antenna 14.

FIG. 5C shows a further embodiment comprising a flat antenna 14 arranged on a substrate 11, and a three-dimensional antenna 13 arranged on the substrate 11. A difference from the previously mentioned embodiments is that a first end 13A, or a first mounting portion 13A, of the three-dimensional antenna 13 indeed continues to be arranged on the fastening area 17. However, the second end 13B, or the second mounting portion 13B, is arranged on the flat antenna 14 and may be mechanically, and optionally galvanically, coupled to the flat antenna 14.

In accordance with this embodiment, therefore, a first mounting portion 13A of the three-dimensional antenna 13 is arranged on the substrate 11, or on the first fastening area 17, and a second mounting portion 13B of the three-dimensional antenna 13 is arranged on the flat antenna 14.

The first mounting portion 13A of the three-dimensional antenna 13 may be mechanically, and optionally galvanically, coupled to the first fastening area 17. The second mounting portion 13B of the three-dimensional antenna 13 may be mechanically, and optionally galvanically, coupled to the flat antenna 14.

In principle, the second fastening area 17, or the first mounting portion 13A which is not coupled to the flat antenna 14, of the three-dimensional antenna 13 may be arranged on the substrate 11 at any location, i.e., may be arranged within a range of 360° around the flat antenna 14.

Figure 5D:
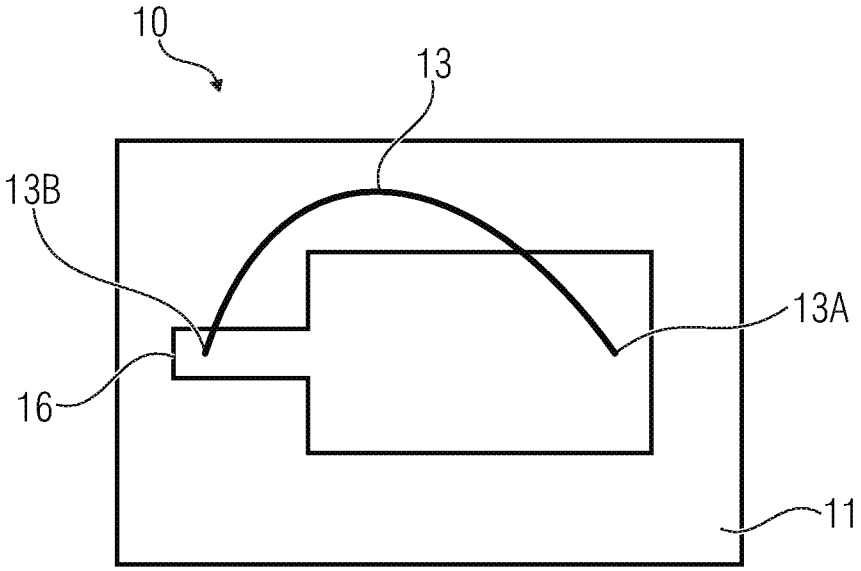
FIG. 5D shows a top view of an inventive Ndip antenna in accordance with a further embodiment.

FIG. 5D shows a further embodiment comprising a flat antenna 14 arranged on a substrate 11, and a three-dimensional antenna 13 arranged on the substrate 11. A difference from the previously mentioned embodiments is that a first end 13A, or a first mounting portion 13A, of the three-dimensional antenna 13 is arranged on the flat antenna 14, whereas the second end 13B, or the second mounting portion 13B, of the three-dimensional antenna 13 is arranged on the shared signal feeding portion 16.

The first mounting portion 13A of the three-dimensional antenna 13 may be mechanically, and optionally galvanically, coupled to the flat antenna 14. The second mounting portion 13B of the three-dimensional antenna 13 may be mechanically, and optionally galvanically, coupled to the shared signal feeding portion 16.

In accordance with embodiments of the present invention, the three-dimensional antenna 13 may be a bond wire antenna comprising at least one bond wire 13. Alternatively, the three-dimensional antenna 13 may be a ribbon bond antenna comprising at least one ribbon.

Alternative embodiments provide for the three-dimensional antenna 13 to be a bond wire antenna comprising at least two bond wires 13, or for the three-dimensional antenna 13 to be a ribbon bond antenna comprising at least two ribbons. In this manner, the performance of the Ndip antenna 10 may be improved.

The at least two or more bond wires or ribbons may either be equal in length or may have different lengths. The at least two bond wires or ribbons may each be placed at the same locations, for example on the shared signal feeding portion 16 and on the first fastening area 17. In this case, what is at hand is a three-dimensional antenna 13 comprising several bond wires or ribbons.

Figure 6:
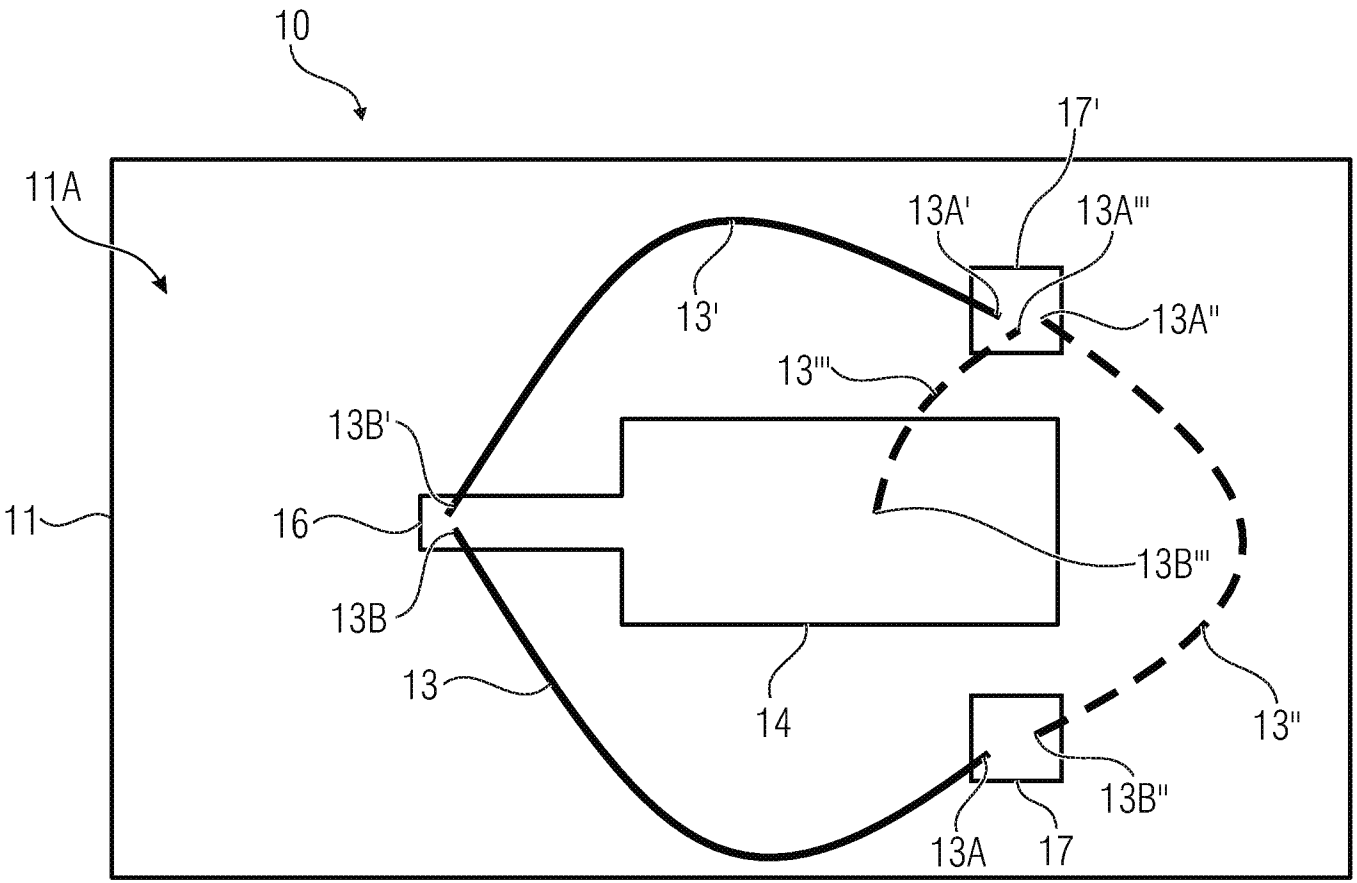
FIG. 6 shows a top view of an inventive Ndip antenna in accordance with a further embodiment, FIG. 7 a top view of an inventive antenna array comprising two inventive Ndip antennas.

FIG. 6 shows a further embodiment of the inventive Ndip antenna 10. In addition to the previously mentioned first three-dimensional antenna 13, the Ndip antenna 10 here also comprises at least one further three-dimensional antenna 13', 13", 13'". Each of said further three-dimensional antennas 13', 13", 13'" may in turn have two or more bond wires or ribbons, as was described above.

In accordance with one embodiment, the Ndip antenna 10 here comprises a second three-dimensional antenna 13' and a second fastening area 17' arranged on the first main side 11A of the substrate 11. The first fastening area 17 and the second fastening area 17' may be galvanically disconnected from each other. A first mounting portion 13A' of the second three-dimensional antenna 13' is arranged on the second fastening area 17'.

A second mounting portion 13B' of the second three-dimensional antenna 13' is arranged on the shared signal feeding portion 16.

Alternatively or additionally, the second, or a third, three-dimensional antenna may be arranged on the first fastening area 17 and on the second fastening area 17'. This is depicted in the form of the optional three-dimensional antenna 13" shown in dashed lines. Here, a first mounting portion 13A" is arranged on the second fastening area 17', and a second mounting portion 13B" is arranged on the first fastening area 17.

Alternatively or additionally, the second, or a fourth, three-dimensional antenna may be arranged at the first fastening area 17 and on the flat antenna 14. This is depicted in the form of the optional three-dimensional antenna 13'" shown in dashed lines. Here, a first mounting portion 13A'" is arranged on the second fastening area 17', and a second mounting portion 13B'" is arranged on the flat antenna 14.

Such a further three-dimensional antenna 13', 13", 13'" may generally be combinable with any of the embodiments depicted in FIGS. 5A, 5B, 5C and 5D.

Figure 7:
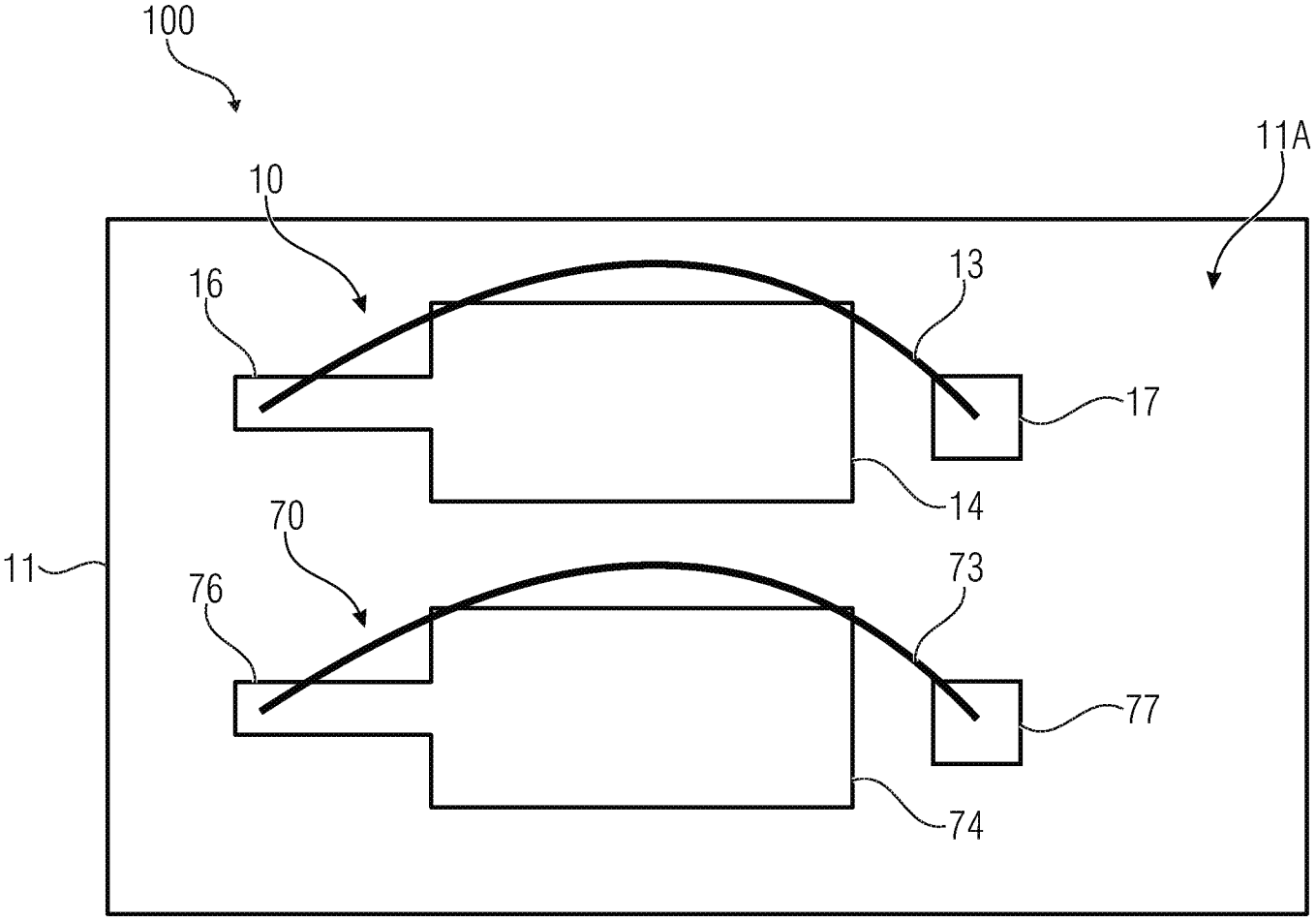

FIG. 7 shows a further embodiment having an inventive antenna array 100. The antenna array 100 comprises an Ndip antenna 10 as was previously described with reference to FIGS. 2A to 6. This means that the antenna array 100 comprises an Ndip antenna 10 having a flat antenna 14 arranged on a substrate 11 and a three-dimensional antenna 13 arranged on the substrate 11.

In addition, the antenna array 100 comprises a second antenna device 70 arranged on the same substrate 11. The second antenna device 70 corresponds to the previously described Ndip antenna 10 in terms of its design as well as in terms of its possible implementations.

The second antenna device 70 also has a second flat antenna 74 arranged on the first main side 11A of the substrate 11 and a second three-dimensional antenna 73.

The second flat antenna 74 extends, within a plane, in parallel with any of the two main sides 11A, 11B of the substrate 11, and the second three-dimensional antenna 73 is spaced apart, at least in portions, from the first main side 11A of the substrate 11.

Also by analogy with the first Ndip antenna 10, with the second antenna device 70, the second three-dimensional antenna 73 and the second flat antenna 74 are galvanically connected to each other. In accordance with a first embodiment, the second three-dimensional antenna 73 and the second flat antenna 74 share a signal feeding portion 76. In accordance with an alternative embodiment, the second three-dimensional antenna 73 and the second flat antenna 74 are serially coupled.

As was mentioned before, the second antenna device 70 may also comprise the same embodiments as were described above with reference to FIGS. 2 to 6.

Figure 8A:
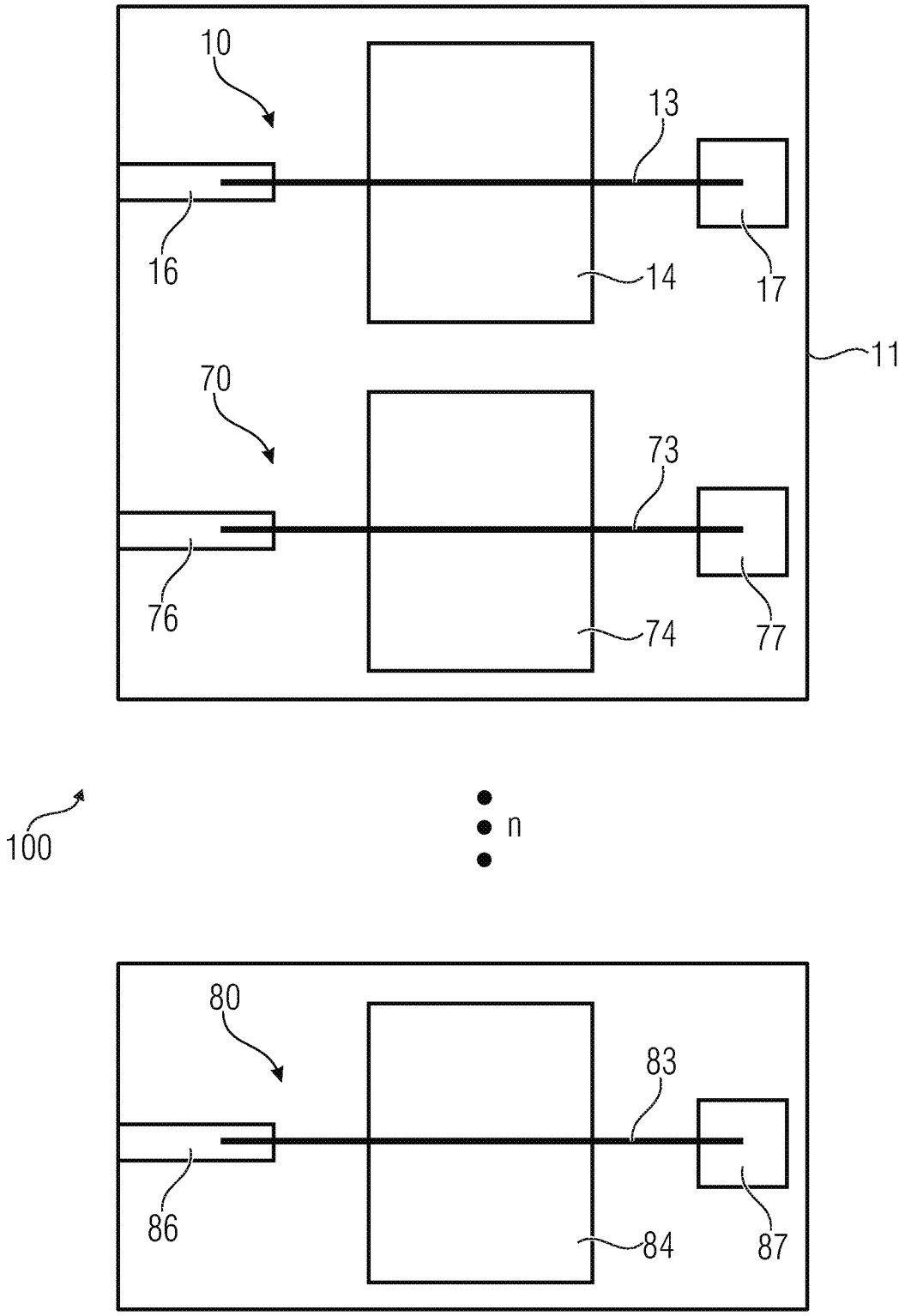
FIG. 8A shows a top view of an inventive antenna array comprising n inventive Ndip antennas.

FIG. 8A shows a further embodiment of an inventive antenna array 100. FIG. 8A is to illustrate that any number n of Ndip antennas 10 which together form an inventive antenna array 100 may be provided on the shared substrate 11.

Figure 8B:
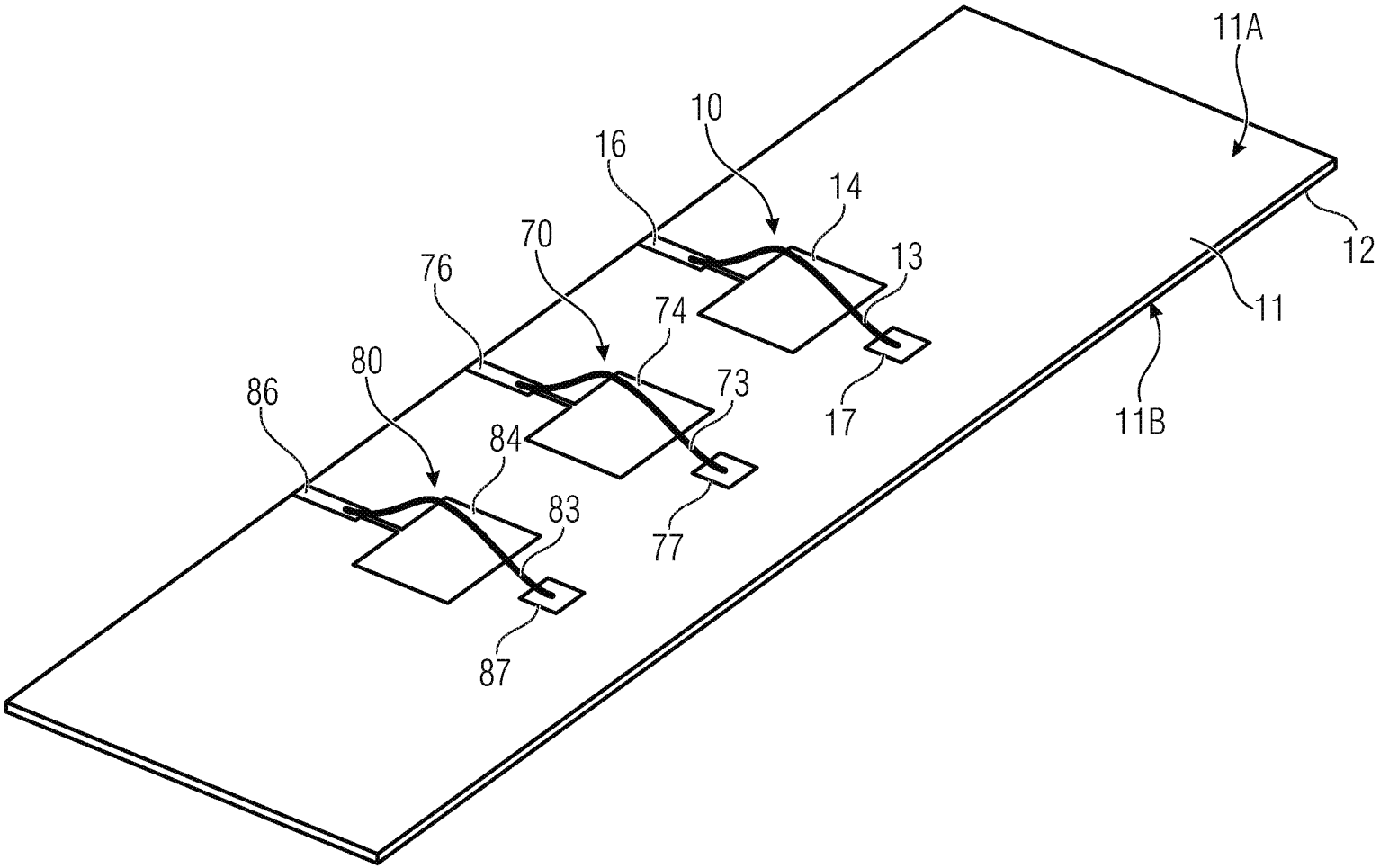
FIG. 8B shows a perspective view of an inventive antenna array comprising three inventive Ndip antennas on a shared substrate.

By way of example, FIG. 8B shows an inventive antenna array 100 comprising three Ndip antennas 10, 70, 80, all of which are arranged on a shared substrate 11. All of the features and functions mentioned above with reference to a single Ndip antenna 10 also apply, to the same extent, to each individual one of the Ndip antennas 10, 70, 80 depicted in FIG. 8B.

Each of the previously described inventive antenna devices 10, also referred to as Ndip antennas, may be implemented as a reconfigurable and/or controllable antenna device. Such an Ndip antenna 10 comprises means for controlling the phase(s) and/or the amplitude(s) of the three-dimensional antenna 13 and/or of the flat antenna 14. Such means may be a switch, for example, configured to switch the signal, which is applied at the three-dimensional antenna 13 and/or the flat antenna 14, such that the amplitude and/or the phase of said signal is controllable. Alternatively or additionally, the three-dimensional antenna 13 and/or the flat antenna 14 may be reconfigurable, so that the zero-point passage of the applied signal may be re-determined.

Figure 9A:
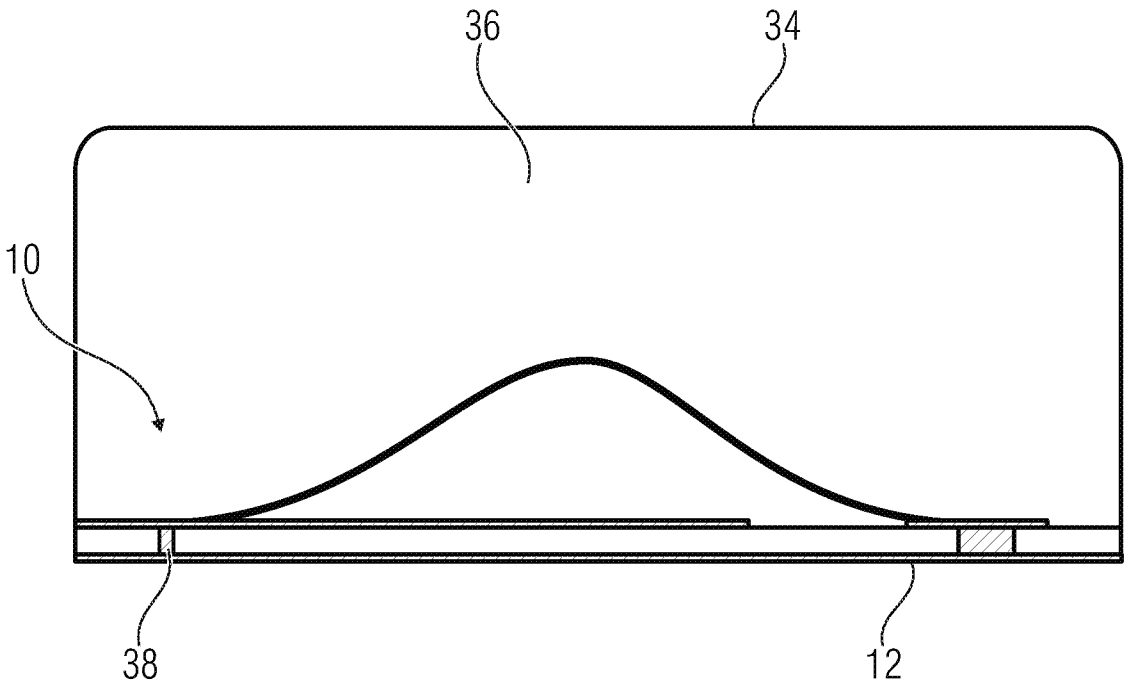
FIG. 9A shows a schematic sectional side view of an antenna device in accordance with an embodiment, which includes a housing.

FIG. 9A shows a schematic sectional side view of an antenna device 90 in accordance with an embodiment. The antenna device 90 includes a housing 34 which has an antenna device, e.g., the Ndip antenna 10, arranged therein. The housing 34 is configured to include, at least in areas, a dielectric or electrically insulating material so as to enable the radio signal to exit from the housing 34. For example, the housing 34 may include a plastic material or a glass material. Plastic material may be arranged during dicing and encapsulating of the Ndip antenna 10 from a wafer. Alternatively or additionally, one or several antenna arrays 100 in accordance with embodiments described herein may be arranged inside the housing 34. An internal volume 36 of the housing 34 may be at least partially filled with a gas, such as air, or a material having a small dielectric constant, or be filled with a material that leads to a small degree of power loss.

The housing 34 includes a terminal 38 connected to the Ndip antenna 10. The terminal 38 is configured to be connected to a signal output of a high-frequency chip. This means that e.g., a high-frequency signal may be received via the terminal 38, which signal may be converted to a radio signal by the Ndip antenna 10. The housing 34 may comprise a further terminal connected to the metallization 12. Alternatively, the metallization 12 may also form an outer wall of the housing 34 so as to enable contacting between the metallization 12 with other components in a simple manner. The terminal 38 may be connected to the electrically conductive structure, which is implemented as a via, for example. The terminal 38 may serve to provide a vertical connection to the Ndip antenna 10 so as to excite the Ndip antenna 10, e.g., by means of a probe feed. Thus, the terminal 38 may provide a contact with the surroundings of the antenna device 90.

Figure 9B:
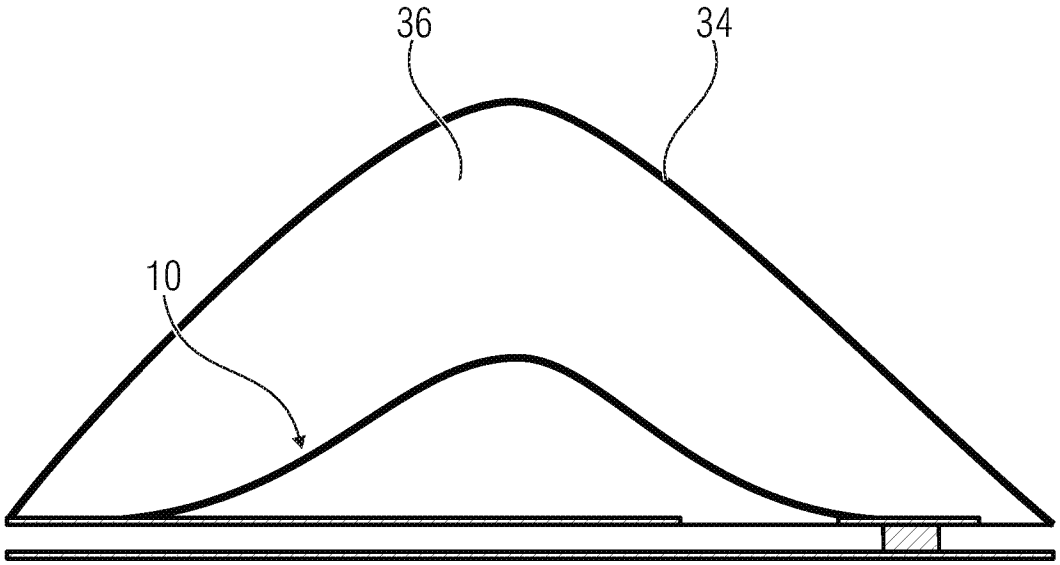
FIG. 9B shows a schematic sectional side view of an antenna device in accordance with a further embodiment, wherein the housing is formed as a structure focusing or scattering a radio signal.

FIG. 9B shows a schematic sectional side view of an antenna device 90' in accordance with an embodiment, wherein the housing 34 is configured, in contrast to FIG. 9A, as a structure configured to influence a radiation pattern of the radio signal 26. Such a structure may be referred to as a lens, for example. For example, the structure of the housing 34 may be configured to focus the radio signal of the Ndip antenna. For example, the interior 36 of the housing 34 may be at least partly filled with a dielectric material, and an outer shape of the housing 34 may be concave or convex so as to obtain a scattering or focusing function of the lens.

The invention is to be briefly summarized once again in other words below.

The present invention relates to a novel Ndip antenna 10 exhibiting the features of claim 1. This Ndip antenna 10 solves the disadvantages and problems of conventional technology which were mentioned at the outset and which result from many technical limitations of known antennas.

The inventive Ndip antenna 10 may be referred to as a hybrid antenna which can be achieved by combining one or more three-dimensional antennas 13, 13', 13", 13'" (e.g., bond wire antennas, ribbon bond antennas, etc.) with one or more flat antennas 14, 74 (e.g., patch, monopole, dipole, etc.) so as to obtain a desired performance which cannot be attained with a single three-dimensional and/or flat antenna.

In order to ensure that the radiation pattern of the inventive Ndip antenna 10 represents a true hybrid of the two individual antennas 13, 14, the three-dimensional antenna 13 and the flat antenna 14 are combined such that radiation coupling between the two antennas 13, 14 will be at a minimum at those points where they each have their respective maximum field strength values. This will then result in constructive interference.

For example, the Ndip antenna 10 depicted in FIG. 2 comprises two resonant antennas, e.g., a patch antenna 14 and a bond wire antenna 13. Those two antennas 13, 14 are combined with each other such that the radiation coupling is at a minimum at the points $L=0$, $L=\lambda/4$ and $L=\lambda/2$, wherein L is the geometric length of the respective antenna 13, 14, and $\lambda$ is the wavelength of the shared fed signal.

If therefore, e.g., the Ndip antenna 10 depicted in FIG. 2 is excited at the shared signal feeding portion 16, a standing wave will occur at the flat antenna 14 and at the three-dimensional antenna 13, respectively.

The current distribution on the patch 14 is proportional to $$\left|\sin\frac{2\pi L}{\lambda}\right|$$

since the patch 14 has an open end, i.e., the patch antenna 14 is not terminated. A current distribution which is proportional to $$\left|\cos\frac{2\pi L}{\lambda}\right|$$

will arise at the three-dimensional antenna 13 since the end of the three-dimensional antenna 13 is terminated, or short-circuited.

This is why the maximum value of the current on the three-dimensional antenna 13 lies approximately where the minimum value of the current of the patch antenna 14 lies, as shown in FIG. 3. For this reason, the inventive Ndip antenna 10 radiates very well both into the horizontal (azimuthal) plane and into the vertical (elevation) plane, as shown in FIG. 4C.

The starting and end points of the three-dimensional antenna 13 (e.g., wire ends, or wire tips) may lie, e.g., on the shared signal feeding portion 16 and the first fastening area 17. At least one of the two end points, however, may also be arranged in an arbitrary manner on the substrate 11 within a range of 360° around the flat antenna 14.

It is also possible to utilize a multitude of wires, ribbons, etc. In this case (see FIG. 6), a wire 13, or ribbon 13, etc., may be arranged, e.g., at the shared signal feeding portion 16 and the first fastening area 17, whereas a different wire, or ribbon, 13', 13", 13'" is arranged at other places on the substrate 11, on the flat antenna 14, on the first and/or a second fastening area 17, 17' and/or on the shared signal feeding portion 16.

The number and the position of the three-dimensional antenna 13 may be varied so as to change the radiation pattern of the Ndip antenna 10. This radiation pattern may also be adjustable, e.g., as a function of whether the flat antenna 14 is arranged at the beginning or at the end of the three-dimensional antenna 13.

Two or more Ndip antennas 10, 70, which may be arranged on a shared substrate 11, may also be combined to form an antenna array 100.

The inventive Ndip antenna 10 may also be designed to comprise a very large bandwidth as compared to conventional antennas. To achieve this, the three-dimensional antenna 13 and the flat antenna 14 may be optimized such that their resonant frequencies mutually overlap. The resulting bandwidth will thus be substantially larger than the bandwidth of conventional antennas.

The inventive Ndip antenna 10 may also be designed as a multiband antenna. To achieve this, the three-dimensional antenna 13 and the flat antenna 14 may be optimized in terms of respectively different resonant frequencies, and/or of multiples of the basic resonant frequency. Thus, several transmission bands may be achieved.

Since at least one of both antennas 13, 14 of the inventive Ndip antenna 10 is vertically spaced apart, or "suspended", from the dielectric substrate 11, most losses associated with dielectrics (e.g., losses due to surface waves, conductivity of the dielectric and loss factor) will be minimized. For this reason, it is possible to achieve a considerably higher radiation efficiency with the inventive Ndip antenna 10.

In order to maintain, e.g., ambient air as a dielectric surrounding the three-dimensional antenna 13, a cover, e.g., a glass lid, may be provided for covering the inventive Ndip antenna 10. Said cover may be arranged, for example, on the first main side 11A of the substrate 11 so as to cover at least the three-dimensional antenna 13.

The Ndip antenna 10 may be fed in different ways. For example, planar feeding (e.g., microstrip line, coplanar feeding) may be used for this purpose. Alternatively or additionally, e.g., the shared signal feeding portion 16 may be connected to a strip line (microstrip) so as to obtain an electric signal. Alternatively or additionally, the electric signal may be fed by means of electromagnetic coupling, for example by means of so-called aperture coupling (aperture feed) or by means of proximity feed, and/or by means of vertical contacting, e.g., while using a via.

A reconfigurable Ndip antenna 10 may be implemented, e.g., by arranging a switch between the three-dimensional antenna 13 and the flat antenna 14. For example, if a switch is arranged at the shared signal feeding portion 16 (FIG. 2), the current flow toward the three-dimensional antenna 13 and toward the flat antenna 14 may be controlled. By controlling the current flow of the individual antennas 13, 14, the radiation pattern of the Ndip antenna 10 may also be controlled.

The three-dimensional antenna 13 and the flat antenna 14 may be connected in parallel or in series.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An antenna device comprising a substrate comprising a first main side and a second main side located opposite the first main side, wherein a metallization is arranged, at least in portions, on the second main side of the substrate, wherein at least one flat antenna and at least one three-dimensional antenna are arranged on the first main side of the substrate, wherein the flat antenna extends, within a plane, in parallel with one of the two main sides of the substrate, and wherein the three-dimensional antenna is spaced apart, at least in portions, from the first main side of the substrate, wherein the three-dimensional antenna and the flat antenna are galvanically connected to each other at a shared signal feeding portion, and wherein the three-dimensional antenna extends at least in portions across the flat antenna.

2. The antenna device as claimed in claim 1, wherein the flat antenna and the three-dimensional antenna each comprise a geometric length at which, when the flat antenna and the three-dimensional antenna are fed with the same signal, a current density distribution in the form of a standing wave occurs along the geometric length of the flat antenna, said current density distribution exhibiting a phase offset in relation to a current density distribution which occurs within the three-dimensional antenna in the form of a standing wave along the geometric length of the three-dimensional antenna, the phase offset amounting to at least one of 90°±20%, 90°±10% and 90°.

3. The antenna device as claimed in claim 1, wherein the flat antenna is a non-terminated antenna, and wherein the three-dimensional antenna is short-circuited, and/or wherein a current density distribution proportional to $$\left|\sin\frac{2\pi\cdot L}{\lambda}\right|$$

occurs at the flat antenna, and wherein a current density distribution proportional to $$\left|\cos\frac{2\pi\cdot L}{\lambda}\right|$$

occurs at the three-dimensional antenna, wherein L is a geometric length of the respective antenna.

4. The antenna device as claimed in claim 1, wherein both a geometric length of the flat antenna and a geometric length of the three-dimensional antenna each correspond to an integer multiple of $$\frac{\lambda}{4}.$$

5. The antenna device as claimed in claim 1, wherein the flat antenna and the three-dimensional antenna each are resonant antennas, wherein the flat antenna is tuned to a first resonant frequency and the three-dimensional antenna is tuned to a second resonant frequency, the first and second resonant frequencies deviating from each other by less than 5%.

6. The antenna device as claimed in claim 1, wherein the flat antenna and the three-dimensional antenna each are resonant antennas, wherein the flat antenna is tuned to a first resonant frequency and the three-dimensional antenna is tuned to a second resonant frequency, the first and second resonant frequencies deviating from each other by 5% or more.

7. The antenna device as claimed in claim 1, wherein at least the flat antenna or at least the three-dimensional antenna is galvanically or capacitively coupled to the metallization located on the second main side of the substrate.

8. The antenna device as claimed in claim 1, wherein a first mounting portion of the three-dimensional antenna is arranged on a first fastening area arranged on the first main side of the substrate, and a second mounting portion of the three-dimensional antenna is arranged on the flat antenna or on the shared signal feeding portion.

9. The antenna device as claimed in claim 8, wherein the first fastening area is galvanically or capacitively coupled to the metallization located on the second main side of the substrate.

10. The antenna device as claimed in claim 8, wherein the first fastening area is arranged, in relation to the flat antenna, opposite the shared signal feeding portion, and wherein the three-dimensional antenna extends at least in said portions across the flat antenna, between the shared signal feeding portion and the first fastening area, while being spaced apart from the flat antenna in a direction orthogonal to the substrate plane.

11. The antenna device as claimed in claim 10, wherein the flat antenna comprises a geometric length and wherein the three-dimensional antenna comprises, at a position corresponding to a geometric length of $$L = \frac{\lambda}{4}$$

of the flat antenna, a first distance from the flat antenna which is directed orthogonally to the substrate plane, and wherein the three-dimensional antenna comprises, at a position corresponding to a geometric length of $$L = 0 \text{ or } L = \frac{\lambda}{2}$$

of the flat antenna, a second distance from the flat antenna which is directed orthogonally to the substrate plane, the amount of the first distance exceeding the amount of the second distance.

12. The antenna device as claimed in claim 8, wherein the first fastening area is arranged, in relation to the shared signal feeding portion, opposite the flat antenna, so that the shared signal feeding portion is spatially arranged between the first fastening area and the flat antenna, the first fastening area, the shared signal feeding portion, and the flat antenna all being arranged along a shared straight line.

13. The antenna device as claimed in claim 8, wherein the flat antenna and the shared signal feeding portion are arranged along a first shared straight line, and the first fastening area and the shared signal feeding portion are arranged along a second shared straight line, the first shared straight line and the second shared straight line extending orthogonally to each other.

14. The antenna device as claimed in claim 1, wherein a first mounting portion of the three-dimensional antenna is arranged on the flat antenna, and a second mounting portion of the three-dimensional antenna is arranged on the shared signal feeding portion.

15. The antenna device as claimed in claim 1, wherein the three-dimensional antenna is a bond wire antenna comprising at least one bond wire, or wherein the three-dimensional antenna is a ribbon bond antenna comprising at least one ribbon.

16. The antenna device as claimed in claim 1, wherein the three-dimensional antenna is a bond wire antenna comprising at least two bond wires, or wherein the three-dimensional antenna is a ribbon bond antenna comprising at least two ribbons.

17. The antenna device as claimed in claim 1, the antenna device comprising a second three-dimensional antenna and a second fastening area arranged on the first main side of the substrate, wherein a first mounting portion of the second three-dimensional antenna is arranged on the second fastening area, and a second mounting portion of the second three-dimensional antenna is arranged on the first mounting area or on the flat antenna or on the shared signal feeding portion.

18. The antenna device as claimed in claim 1, the antenna device being implemented as a reconfigurable and/or controllable antenna device which further comprises a unit for controlling the phase and/or the amplitude of the three-dimensional antenna and/or of the flat antenna.

19. The antenna device as claimed in claim 1, further comprising a housing which has the antenna device arranged therein, and further comprising a terminal for connecting the antenna device to a high-frequency chip.

20. The antenna device as clamed in claim 19, wherein the housing forms a lens configured to focus or scatter a radio signal generated by the antenna device.

21. An antenna array comprising an antenna device as claimed in claim 1 and, additionally, comprising a second flat antenna arranged on the first main side of the substrate, as well as a three-dimensional antenna, wherein the second flat antenna extends, within a plane, in parallel with one of the two main sides of the substrate, and wherein the second three-dimensional antenna is spaced apart, at least in portions, from the first main side of the substrate, wherein the second three-dimensional antenna and the second flat antenna are galvanically connected to each other at a shared signal feeding portion, and wherein the second three-dimensional antenna extends at least in portions across the second flat antenna.

* * * * *